US007118431B2

(12) United States Patent
Mizuno et al.

(10) Patent No.: US 7,118,431 B2
(45) Date of Patent: Oct. 10, 2006

(54) WATERCRAFT STEERING ASSIST SYSTEM

(75) Inventors: Yutaka Mizuno, Iwata (JP); Ryoichi Nakase, Iwata (JP); Tsuide Yanagihara, Iwata (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/659,424

(22) Filed: Sep. 10, 2003

(65) Prior Publication Data

US 2004/0147179 A1 Jul. 29, 2004

Related U.S. Application Data

(60) Provisional application No. 60/458,068, filed on Mar. 26, 2003.

(30) Foreign Application Priority Data

Sep. 10, 2002 (JP) ..... 2002-263681
Jun. 10, 2003 (JP) ..... 2003-165262

(51) Int. Cl.
*B63H 21/21* (2006.01)
*B63H 11/107* (2006.01)
*B63H 11/113* (2006.01)
*B63H 11/117* (2006.01)

(52) U.S. Cl. ..... 440/1

(58) Field of Classification Search ..... 440/1, 440/84, 87, 40–43; 114/144 R, 144 E, 144 RE, 114/150, 151; 244/236
See application file for complete search history.

(56) References Cited

U.S. PATENT DOCUMENTS 4,423,630 A * 1/1984 Morrison ..... 73/379.01
5,167,547 A 12/1992 Kobayashi et al.
5,271,351 A 12/1993 Horiuchi et al.
5,531,619 A 7/1996 Nakase et al.
5,797,775 A 8/1998 Ozawa et al.
5,902,158 A 5/1999 Nakase et al.
5,967,861 A 10/1999 Ozawa et al.
6,086,437 A 7/2000 Murray
6,138,632 A 10/2000 Nakase
6,200,178 B1 3/2001 Nakase et al.
6,336,833 B1 1/2002 Rheault et al.
6,345,544 B1 2/2002 Mizuno et al.
6,371,819 B1 4/2002 Ozawa et al.
6,425,789 B1 7/2002 Nakase et al.
6,428,372 B1 8/2002 Belt (Continued)

FOREIGN PATENT DOCUMENTS

CA 2271332 2/2000

(Continued)

*Primary Examiner*—Sherman Basinger
(74) *Attorney, Agent, or Firm*—Knobbe, Martens, Olson & Bear, LLP

(57) ABSTRACT

A steering assist system for a watercraft including a force detection assembly adapted to detect a force further applied to an operator steering control of the watercraft after the steering control is turned to a maximum turning position. The steering assist system also includes a controller configured to increase a steering force produced by the watercraft in response to an output of the force detection assembly. In one arrangement, the steering assist system increases an output of a propulsion system of the watercraft in proportion to an output of the force detection assembly. In another arrangement, the steering assist system moves a steering force producing member, such as a deflector or rudder, for example, in response to an output of the force detection assembly in addition to, or alternative to, increasing an output of the propulsion system.

29 Claims, 23 Drawing Sheets

U.S. PATENT DOCUMENTS

| | | | | |
|---|---|---|---|---|
| 6,478,638 | B1 * | 11/2002 | Matsuda et al. | 440/1 |
| 6,530,812 | B1 | 3/2003 | Koyano et al. | |
| 2001/0027739 | A1 | 10/2001 | Simard et al. | |
| 2001/0029791 | A1 * | 10/2001 | Sezaki | 73/862.333 |
| 2002/0028613 | A1 | 3/2002 | Matsuda et al. | |
| 2002/0077009 | A1 | 6/2002 | Swarz et al. | |

FOREIGN PATENT DOCUMENTS

| | | |
|---|---|---|
| JP | 57-084297 | 5/1982 |
| JP | 2001-329881 | 11/2001 |

* cited by examiner

WATERCRAFT STEERING ASSIST SYSTEM

RELATED APPLICATIONS

The present application is related to, and claims priority from, U.S. Provisional Patent Application No. 60/458,068, filed Mar. 26, 2003 and Japanese Patent Application Nos. 2002-263681, filed Sep. 10, 2002, and 2003-165262, filed Jun. 10, 2003, the entireties of which are expressly incorporated by reference herein.

BACKGROUND OF THE INVENTION

1. Field of the Invention

The present application generally relates to steering systems for watercraft. More particularly, the present invention relates to a steering assist system for a watercraft.

2. Description of the Related Art

Many types of watercraft are at least partially dependent upon a power output from an associated propulsion system to develop a steering force in order to steer the watercraft. As a result, steering of the watercraft may become difficult in situations where the engine speed, and thus the output of the propulsion unit, is low, such as when performing docking maneuvers for example. Coordinating manual control of a throttle assembly to increase the engine speed while also steering the watercraft is often difficult for an operator.

In one prior arrangement, an output of the propulsion unit of the watercraft is increased when a turning angle of an operator's steering control, such as a handlebar assembly or steering wheel for example, is greater than a predetermined turning angle.

SUMMARY OF THE INVENTION

An aspect of at least one of the inventions disclosed herein includes the realization that where thrust of a vehicle is changed based on whether or not the steering mechanism is positioned beyond a predetermined angle, it can be difficult for a rider of such a watercraft to anticipate when the additional thrust will be triggered. For example, as noted above, certain watercraft are provided with a controller that provides additional thrust when the handlebar of the watercraft is turned beyond a predetermined position and when the throttle is released. However, it can be difficult for a rider to remember precisely at what position of the handlebar will the additional thrust be triggered. Thus, one aspect of at least one of the inventions disclosed herein provides a tactile signal to a rider at the position at which additional thrust is triggered. Thus, a rider can more easily anticipate when additional thrust will be provided.

Another aspect of at least one of the inventions disclosed herein includes the realization that the force that a rider applies to a steering member can be used to control thrust, so as to make turning maneuvers easier to perform. For example, a watercraft can include a sensor to detect the force applied to the handlebar or steering wheel thereof, and a controller can adjust the thrust generated by the propulsion system in accordance with the detected force. When the additional thrust is triggered, the watercraft will turn more. Thus, the watercraft takes on a more intuitive operational characteristic, i.e., the more force applied by the rider, the more the watercraft will turn.

A further aspect of at least one of the inventions disclosed herein involves a watercraft including a hull and a propulsion unit supported relative to the hull. A steering system is configured to influence a direction of travel of the watercraft.

The steering system includes an operator steering control configured to rotate a steering shaft between a first maximum turning position and a second maximum turning position to permit an operator of the watercraft to control a position of the steering system. A force detection assembly is configured to sense a force further applied to the operator control after the operator control is turned to either of the first and second maximum turning positions. A control system is configured to increase an output of the propulsion unit when the force further applied to the operator control exceeds a predetermined threshold.

Another aspect of at least one of the inventions disclosed herein involves a watercraft including a hull and a water jet propulsion unit supported relative to the hull. The water jet propulsion unit includes a steering nozzle and a steering system configured to influence a direction of travel of the watercraft. The steering system includes an operator steering control moveable between a first maximum turning position and a second maximum turning position and configured to permit an operator of the watercraft to control a position of the steering nozzle. A force detection assembly is configured to sense a force further applied to the operator control after the operator control is turned to either of the first and second maximum turning positions. A pair of deflectors are supported by the steering nozzle for pivotal motion about a generally vertical axis and straddle a flow of water issuing from the steering nozzle when the pair of deflectors are in a neutral position. A control system is configured to rotate the pair of deflectors relative to the steering nozzle to divert a flow of water issuing from the steering nozzle when the force further applied to the operator control exceeds a predetermined threshold.

Yet another aspect of at least one of inventions disclosed herein involves a watercraft including a hull and a propulsion unit supported relative to the hull. A steering system is configured to influence a direction of travel of the watercraft. The steering system includes an operator steering control moveable between a first maximum turning position and a second maximum turning position and configured to permit an operator of the watercraft to control a position of the steering system. A force detection assembly is configured to sense a force further applied to the operator control after the operator control is turned to either of the first and second maximum turning positions. At least one rudder is supported by the propulsion unit for pivotal motion about a generally horizontal axis from a first position, not providing a substantial steering force, to a second position, configured to provide a steering force with a body of water on which the watercraft is operated. A control system is configured to rotate the at least one rudder toward the second position when the force further applied to the operator steering control exceeds a predetermined threshold.

A further aspect of at least one of the inventions disclosed herein involves a steering assist method for a watercraft. The method includes determining a force applied to an operator steering control tending to move the operator steering control beyond a maximum turning position. The method further includes increasing a steering force of the watercraft when the force further applied to the operator steering control exceeds a predetermined threshold.

BRIEF DESCRIPTION OF THE DRAWINGS

These and other features, aspects, and advantages of the present invention are described with reference to drawings of several preferred embodiments, which are intended to illustrate, and not to limit, the present invention. The drawings include 23 figures.

DETAILED DESCRIPTION OF THE PREFERRED EMBODIMENT

Figure 1:
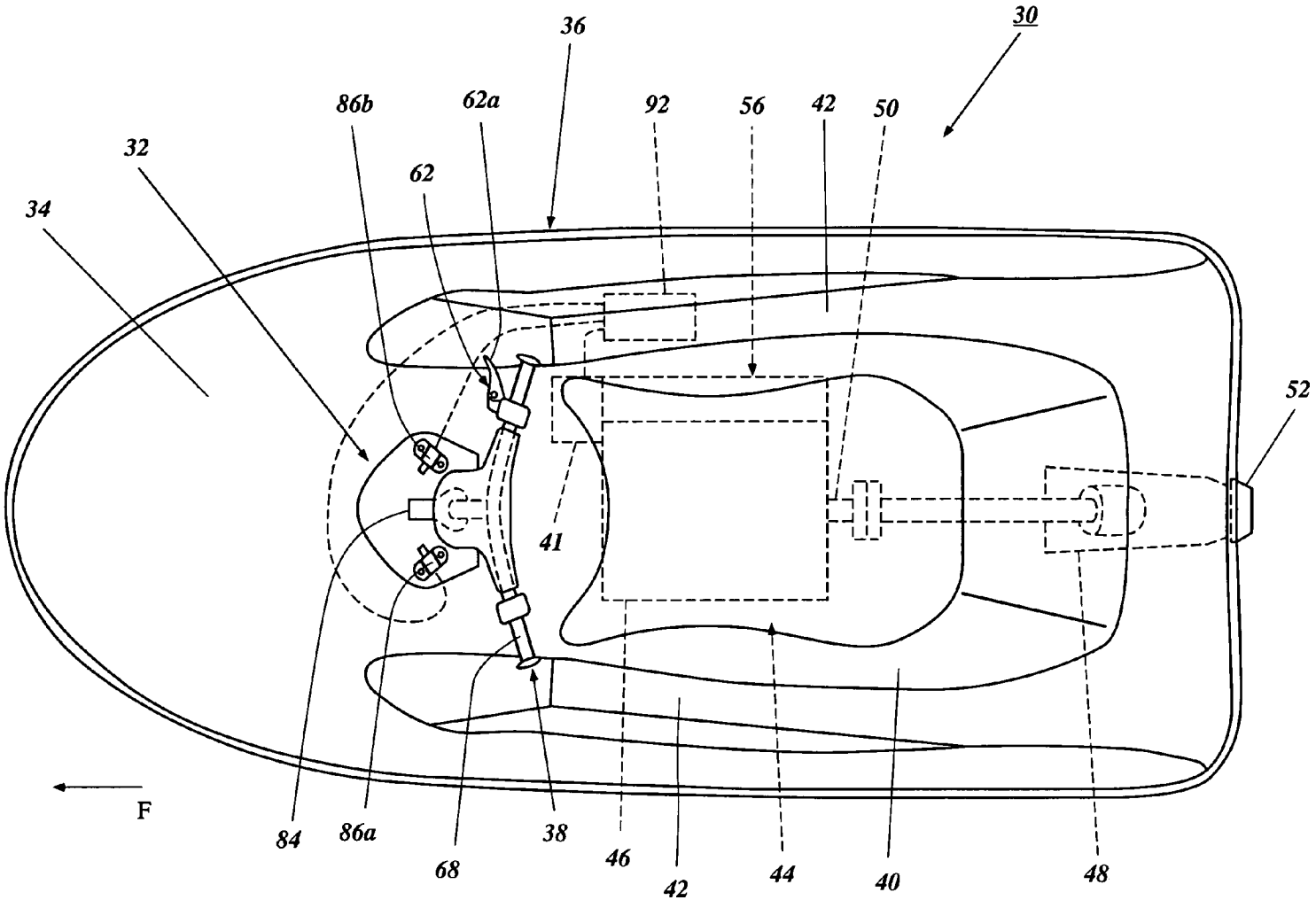
FIG. 1 is a top plan view of a watercraft including a preferred embodiment of the present steering assist system. Several internal components of the watercraft, such as an engine and propulsion unit, are shown in phantom.

FIG. 1 illustrates a personal watercraft, generally indicated by the reference numeral 30, which includes a steering assist system including certain features, aspects and advantages of the present inventions. Although the present steering assist system is illustrated in connection with a personal watercraft, the steering assist system may also be used with other types of watercraft as well, such as, for example, but without limitation, small jet boats, and watercraft employing inboard or outboard propeller-type motors.

Before describing the present steering system, an exemplary personal watercraft 30 is described in general detail to assist the reader's understanding of a preferred environment of use of the present steering system. The watercraft is described in relation to a coordinate system wherein a longitudinal axis extends along a length of the watercraft 30. A central, vertical plane generally bisects the watercraft 30 and contains the longitudinal axis. A lateral axis extends in a direction normal to the longitudinal axis from a port side to a starboard side of the watercraft 30. Relative heights are expressed as elevations from a surface of a body of water upon which the watercraft 30 operates. In FIG. 1, an arrow F indicates a direction of forward travel of the watercraft 30.

As indicated above, the watercraft 30 preferably includes a steering assist system 32, which is configured to increase a steering force of the watercraft 30 in response to an operator of the watercraft 30 further applying a force to an operator steering control after the operator steering control is turned to a predetermined turning position. In one arrangement, the steering assist system 32 is configured to increase the steering force of the watercraft 30 when an operating speed of an engine of the watercraft 30 is low and, thus, an output of a propulsion system of the watercraft 30 is low, such as during docking maneuvers, for example.

The watercraft 30 has a body including an upper deck 34 and a lower hull portion 36. The upper deck 34 supports an operator steering control, such as a handlebar assembly 38 in the illustrated arrangement. A seat assembly 40 is positioned to a rearward side of the handlebar assembly 38 to support an operator and one or more passengers of the watercraft 30. Preferably, the seat assembly 40 is a straddle-type seat assembly such that the operator and any passengers sit on the seat assembly 40 in a straddle-type fashion. The upper deck 34 also includes a pair of footrests 42 on each side of the seat assembly 40.

A propulsion system 44 propels the watercraft 30 along a surface of a body of water in which the watercraft 30 is operated. The propulsion system 44 includes an internal combustion engine 46 that powers a jet pump unit 48. The jet pump unit 48 issues a jet of water in a rearward direction from a transom end of the watercraft 30 to propel the watercraft 30 in a forward direction F. Preferably, the engine 46 is drivingly coupled to the jet pump unit 48 by an output shaft, which can be a crankshaft 50 of the engine 46. In some embodiments, an output shaft can be driven by a crankshaft 50 of the engine 46 through a gear reduction set (not show).

A steering nozzle 52 is configured to pivot relative to an outlet of the jet pump unit 48 about a generally vertical axis to redirect a flow of water issuing from the jet pump unit 48. The redirection of a flow of water from the jet pump unit 48 produces a reactionary force with the body of water in which the watercraft 30 is operating, which allows a direction of travel of the watercraft 30 to be altered.

Figure 2:
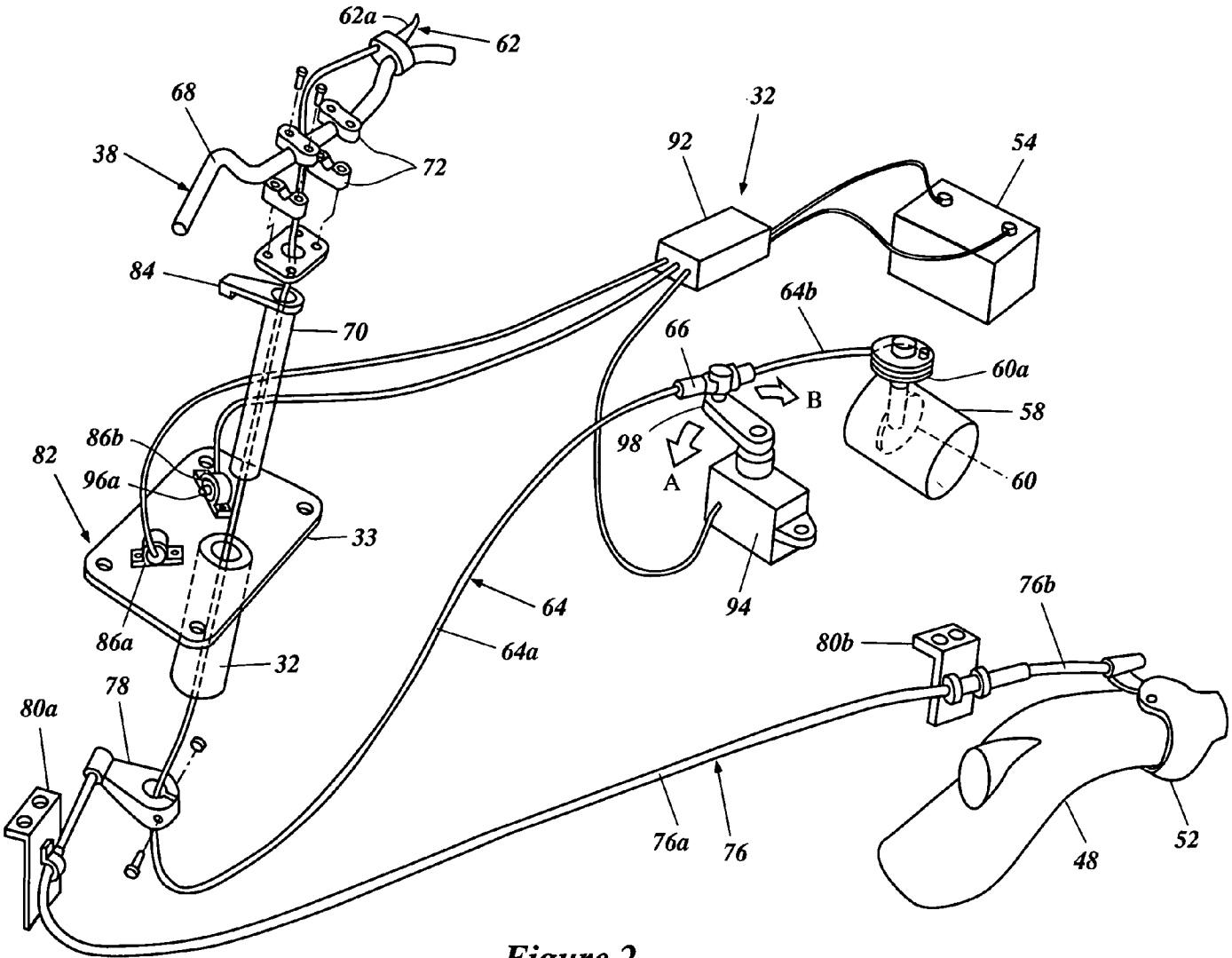
FIG. 2 is a perspective view of the steering assist system of the watercraft of FIG. 1. The steering assist system includes an operator steering control, or handlebar assembly, configured to rotate a steering nozzle of the jet propulsion unit. The steering assist system also includes a force detection assembly configured to sense a force further applied to the operator steering control after the operator steering control is turned to a maximum turning position.
Figure 3:
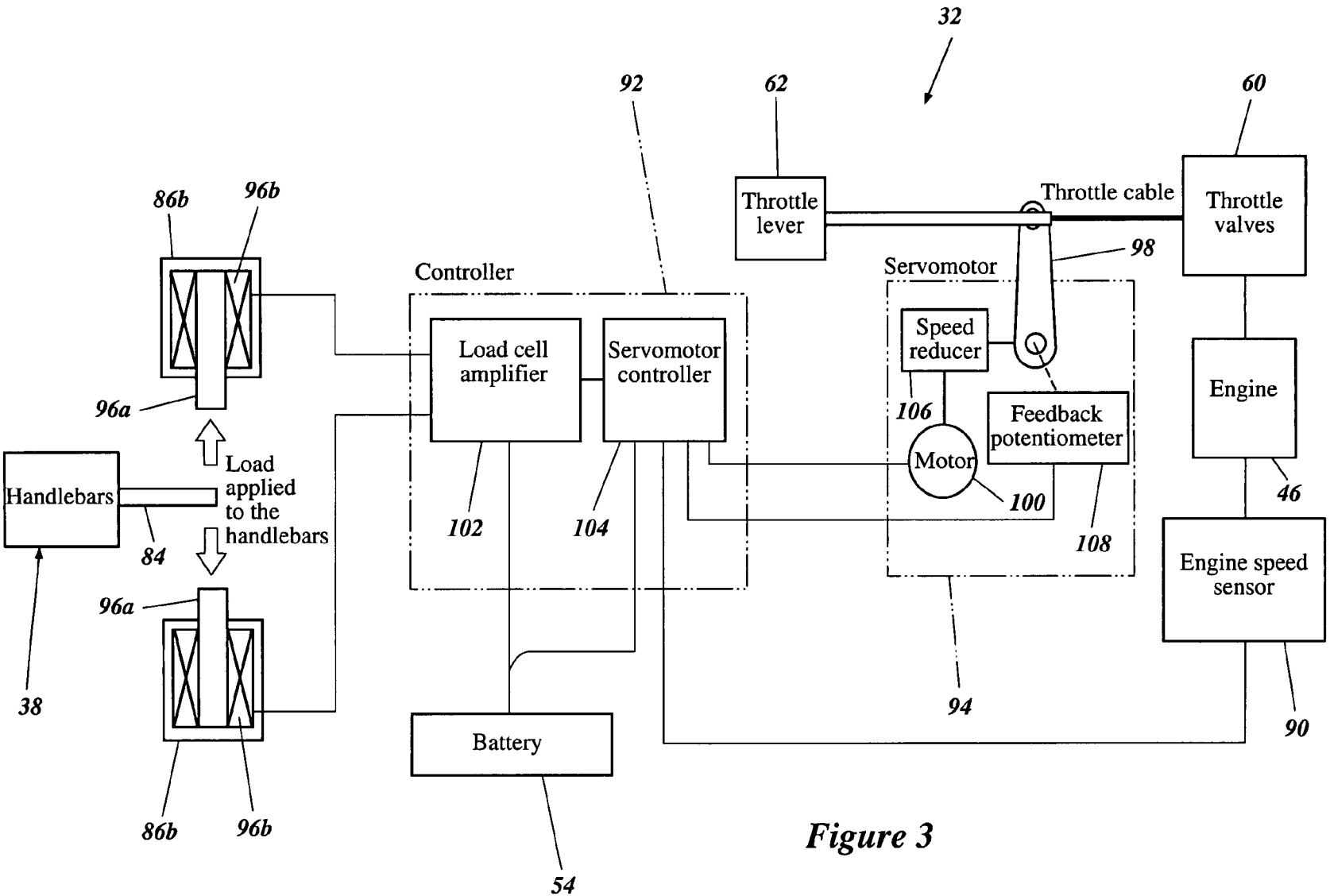
FIG. 3 is a schematic illustration of the steering assist system of FIG. 2.

With reference to FIGS. 1–3, the watercraft 30 also includes a battery 54 configured to supply various components of the watercraft 30, such as the engine 46 for example, with electrical power. In addition, the battery 54 preferably is configured to provide the steering assist system 32 with electrical power.

The engine 46 includes an intake system 56 configured to provide atmospheric air and fuel to one or more combustion chambers (not shown) of the engine 46. The intake system 56 includes one or more throttle bodies 58. Preferably, a throttle body 58 is provided for each combustion chamber of the engine 46. However, for convenience, a single throttle body 58 is described herein.

Each throttle body 58 includes a throttle valve 60, which controls a volume of air that is permitted to pass through the throttle body 58 and into the combustion chamber(s) of the engine 46. If more than one throttle body 58 is provided, preferably the throttle valves 60 of the multiple throttle bodies 58 are interconnected. Thus, movement of one throttle valve 60 results in substantially equal movement of the remaining throttle valves 60.

In addition, the intake system 56 also includes a fuel delivery device such as a carburetor, which may be integrated with the throttle body 58, or a fuel injection system, for example. Preferably, the engine 46 also includes an exhaust system (not shown) configured to evacuate exhaust gases from the combustion chambers of the engine 46, as will be appreciated by one of ordinary skill in the art.

Preferably, a position of the throttle valve 60 is controlled by an operator-controlled throttle lever assembly 62 provided on the handlebar assembly 38 of the watercraft 30. The throttle valve 60 is operably coupled to the throttle lever 62 through a Bowden wire assembly 64, which includes an outer, tubular housing 64*a* and an inner wire 64*b* moveable within the housing 64*a*. The inner wire 64*b* extends between a moveable lever 62*a* of the throttle lever assembly 62 and the throttle valve 60. The housing 64*a* extends between a fixed portion of the throttle lever assembly 62 and a moveable stop 66, which is described in greater detail below.

Thus, when an operator of the watercraft 30 squeezes the throttle lever 62, the inner wire 64*b* is pulled relative to the housing 64*a* to move the throttle valve 60 in a direction toward the fully open position. The handlebar assembly 38 preferably includes a handlebar member 68 coupled to a steering shaft 70 by a handlebar clamp assembly 72. Thus, the steering shaft 70 is configured to rotate along with turning of the handlebar 68. In the illustrated arrangement, the steering shaft 70 is supported within an elongated, tubular steering shaft support 74.

Preferably, a Bowden wire assembly 76 connects the steering nozzle 52 of the jet pump unit 48 to a steering arm 78, which is coupled to a lower end of the steering shaft 70. The Bowden wire 76 includes a housing 76*a* and an inner wire 76*b*. The inner wire 76*b* extends from the steering arm 78 to the steering nozzle 52. The housing 76*a* extends between a first stop 80*a*, proximate the steering arm 78, and a second stop 80*b*, proximate the steering nozzle 52. Thus, when the handlebar 68 is turned, the steering shaft 70 is rotated which, in turn, rotates the steering arm 78. The steering arm 78 applies either a pulling force or a pushing force, depending on the direction of rotation of the handlebar 68, to the inner wire 76*b*, which moves relative to the housing 76*a* to rotate the steering nozzle 52.

Advantageously, the steering system is configured to provide a tactile signal to the rider of the watercraft 30 at the position corresponding to the provision of additional thrust. The steering system can include any type of device for producing a tactile signal to the rider. A further advantage is achieved where the tactile signal is palpable through the handlebar assembly 38.

Preferably, the steering system of the watercraft 30 includes a steering regulator assembly 82, which is configured to define a maximum turning position of the steering shaft 70 (and handlebar 68) when the handlebar assembly 38 is rotated toward either of the port side direction (counterclockwise) and starboard side direction (clockwise) of the watercraft 30. The illustrated steering regulator assembly 82 includes a movable stop member, or stop arm 84, and a pair of fixed stops 86*a*, 86*b*.

The stop arm 84 is fixed for rotation with an upper end of the steering shaft 70. The fixed stops 86*a*, 86*b* are fixed to a mounting plate 88 supported on an upper end of the steering shaft support 74. The stop arm 84 is positioned between the fixed stops 86*a*, 86*b*, which contact the stop arm 84 to limit rotation of the steering shaft 70 and handlebar 68 to physically define the maximum turning positions of the operator steering control, or handlebar assembly 38.

A further advantage is achieved where the tactile signal to the rider regarding when additional thrust will be provided is generated by the limits of travel of the handlebar assembly 38. In the illustrated embodiment, the stops 86*a*, 86*b* define the limits of rotation of the handlebar. Additionally, in the illustrated embodiment, the fixed stops 86*a*, 86*b* are provided in the form of load cells configured to detect a load applied by the stop arm 84 to the load cells 86*a*, 86*b*, which is a function of an additional force applied to the handlebar assembly 38 by an operator of the watercraft 30 after the handlebar assembly 38 has been turned to one of the maximum turning positions. Thus, in the illustrated embodiment, the fixed stops 86*a*, 86*b* (i.e., load cells) form a portion of the steering assist system 32.

The steering assist system 32 additionally includes an engine speed sensor 90 (FIG. 3), a controller 92 and a throttle servomotor assembly 94. The engine speed sensor 90 is configured to determine a rotational velocity of the crankshaft 50 of the engine 46. The controller 92 receives signals originating from the load cells 86*a*, 86*b* and the engine speed sensor 90, and produces an output signal to control the servomotor assembly 94. Preferably, the controller 92 is provided electrical power by the battery 54.

Preferably, each of the load cells 86*a*, 86*b* include a load receiving element 96*a* and a sensor 96*b*. The load receiving element 96*a* is configured to deform in response to a load placed thereon by the stop arm 84 when an operator of the watercraft 30 rotates the handlebar 68 in a direction attempting to move the steering shaft 70 beyond a maximum turning position. The load receiving element 96*a* is constructed of a material having a property that varies in a known relation to a magnitude of the load placed thereon, or the magnitude of the deflection of the load receiving element 96*a*. The sensor

96*b* is configured to detect the change in the property of the load receiving element 96*a* and produce a signal corresponding to the change.

In the illustrated steering assist system 32 of FIGS. 1–3, the load cells 86*a*, 86*b* are of a magnetostrictive type, wherein a magnetic permeability of the load receiving element 96*a* varies in a known relation to the amount of load placed thereon. The sensor 96*b* is configured to detect a change in the magnetic permeability of the load receiving element 96*a*. In other arrangements, the load cells 86*a*, 86*b* may comprise other types of sensors, as will be appreciated by one of skill in the art. For example, the load cells 86*a*, 86*b* can comprise load receiving elements constructed from a conductive rubber material and at least one sensor configured to detect a chanae in an electrical resistance of the load receiving elements.

The servomotor assembly 94 includes an arm 98 rotatable by a motor 100 (FIG. 3) in response to a control signal from the controller 92. The movable stop 66, described above, is supported on a movable end of the arm 98. Thus, when the arm 98 moves in the direction indicated by the arrow A in FIG. 2, an effective length of the housing 64*a* of the throttle wire 64 is increased, which causes the inner wire 64*b* to apply a pulling force to the pulley 60*a* of the throttle valve 60, thereby moving the throttle valve 60 toward a fully open position.

The arm 98 is also movable in a direction indicated by the arrow B to return both the arm 98 and the movable stop 66 to a neutral position, thus returning the throttle valve 60 to a closed position, absent the throttle lever assembly 62 being actuated. Accordingly, the steering assist system 32 is configured to be capable of controlling a position of the throttle valve 60 through the servomotor assembly 94 independently of actuation of the throttle lever 62. As described above, the controller 92 controls the servomotor assembly 94 in response to input signals received by the load cells 86*a*, 86*b* in accordance with a control algorithm, as described in greater detail below with reference to FIG. 4.

With reference to FIG. 3, preferably, the controller 92 additionally includes an amplifier 102 and a servomotor controller 104. The amplifier 102 is configured to amplify a signal produced by the load cells 86*a*, 86*b* so that the amplified signals may be used by the controller 92 in operating the servomotor assembly 94. The servomotor controller 104 is configured to provide an output signal to control the motor 100 to control a position of the arm 98 of the servomotor assembly 94 in accordance with a control algorithm of the steering assist system 32.

As illustrated in FIG. 3, the servomotor assembly 94 preferably includes a speed reducer 106 and a feedback potentiometer 108. The speed reducer 106 is configured to interconnect the motor 100 and the arm 98 to drive the arm 98 at an angular velocity that is less than the angular velocity of the motor 100. The feedback potentiometer 108 is configured to monitor an angle of the arm 98 and provide an output signal corresponding to an angle of the arm 98 to the controller 92. Accordingly, the steering system 32 is apprised of the location of the arm 98 with respect to a predetermined reference angle. Thus, with such an arrangement, the controller 92 is capable of moving the arm 98 until a desired location, or angle, is reached.

Figure 4:
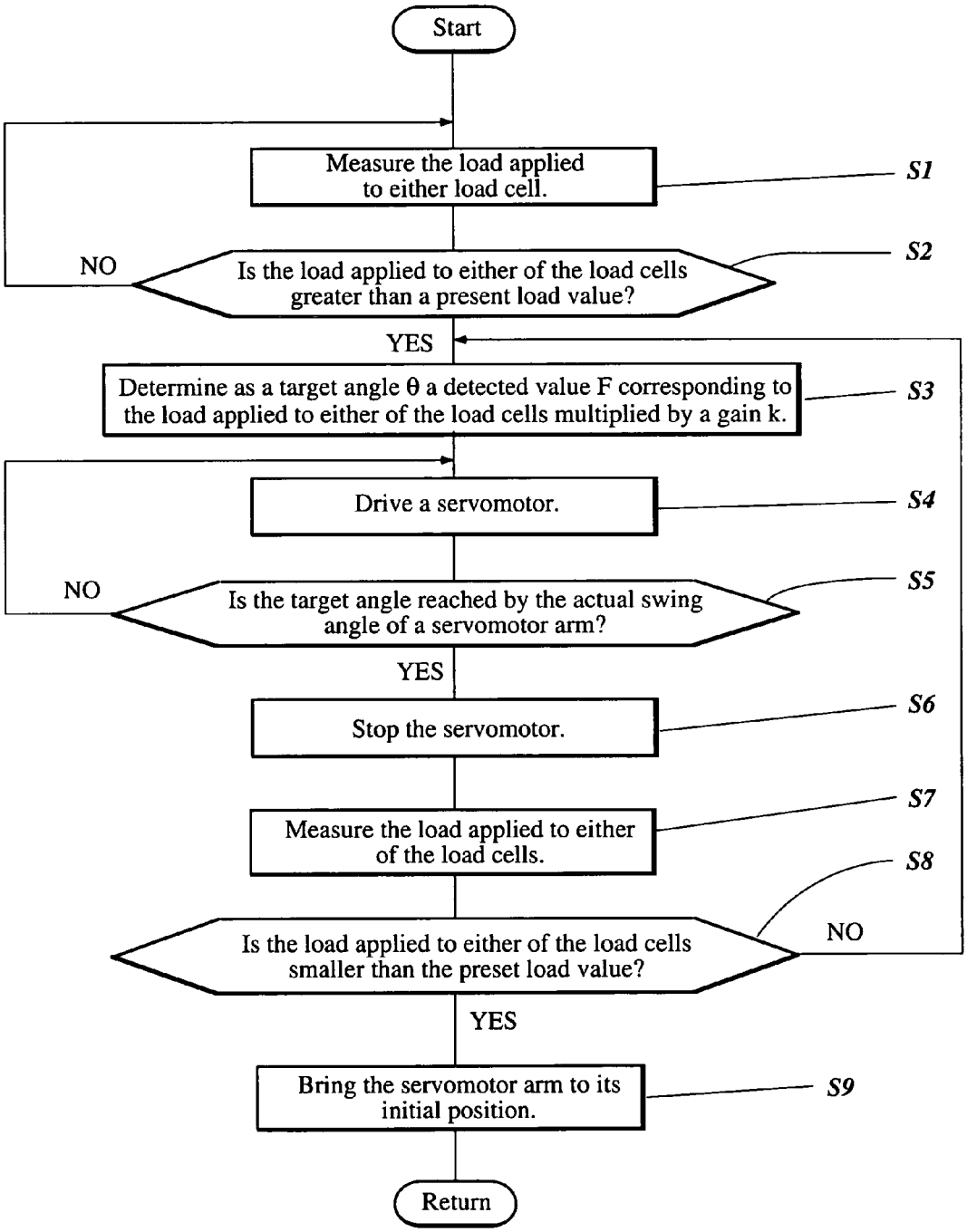
FIG. 4 is an operational flow diagram illustrating a preferred method of operation of the steering assist system of FIG. 2.

With reference to FIG. 4, an operational flow diagram illustrates a preferred operational strategy, or control algorithm, of the illustrated steering assist system 32. Although the illustrated operational strategy is preferred, one of ordinary skill in the art will appreciate that the illustrated operational strategy may be modified and still be capable of carrying out desirable features, aspects and advantages of the present steering assist system 32. For example, certain steps may be performed in an alternative order or the operational strategy may omit, or include additional steps.

From the start of the operational strategy, the system 32 moves to the step S1 wherein a load applied to either load cell 86*a*, 86*b* is measured. Moving to step S2, the system 32 queries whether the load applied to either of the load cells 86*a*, 86*b* is greater than a preset load value. If the answer to the query at step S2 is no, the system 32 starts over and returns to step S1.

On the other hand, if the load applied to either of the load cells 86*a*, 86*b* is greater than a preset load value, the system 32 moves on to step S3. In step S3, the system 32 determines a target angle θ of the arm 98 based on a detected value F, based on an output signal of either load cell 86*a*, 86*b*, which equals the load applied to either of the load cells 86*a*, 86*b* multiplied by a gain K.

The system 32 then moves to step S4, wherein the servomotor assembly 94 drives the arm 98 in a direction toward the target angle. The system 32 then moves to step S5, wherein it queries whether the target angle has been reached by the actual position, or angle, of the servomotor arm 98. If the answer to the query at step S5 is no, the system 32 returns to step S4 and continues to drive the servomotor assembly 94 to move the arm 98 in a direction toward the target angle θ.

If the answer to the query at step S5 is yes, that the angle of the servomotor arm 98 is equal to the target angle θ, the system 32 moves to step S6 wherein the motor 100 is stopped to stop movement of the servomotor arm 98.

The system 32 then moves to step S7, wherein the load applied to either of the load cells 86*a*, 86*b* is measured. The system 32 then moves to step S8 where it is queried whether the load applied to either of the load cells 86*a*, 86*b* is smaller than the preset load value. If the answer to the query at step S8 is no, the system 32 moves to step S3 where a target angle θ of the arm 98 is calculated.

However, if the answer to the query at step S8 is yes, that the load applied to either of the load cells 86*a*, 86*b* is smaller than a preset load value, the system 32 moves to step S9, wherein the servomotor arm 98 is returned to normal operation in which the throttle valve 60 is moved in accordance with the movement of the throttle lever assembly 62. The system 32 then returns to the beginning of the strategy and proceeds to step S1 to monitor a load applied to either load cell 86*a*, 86*b*.

Figure 5:
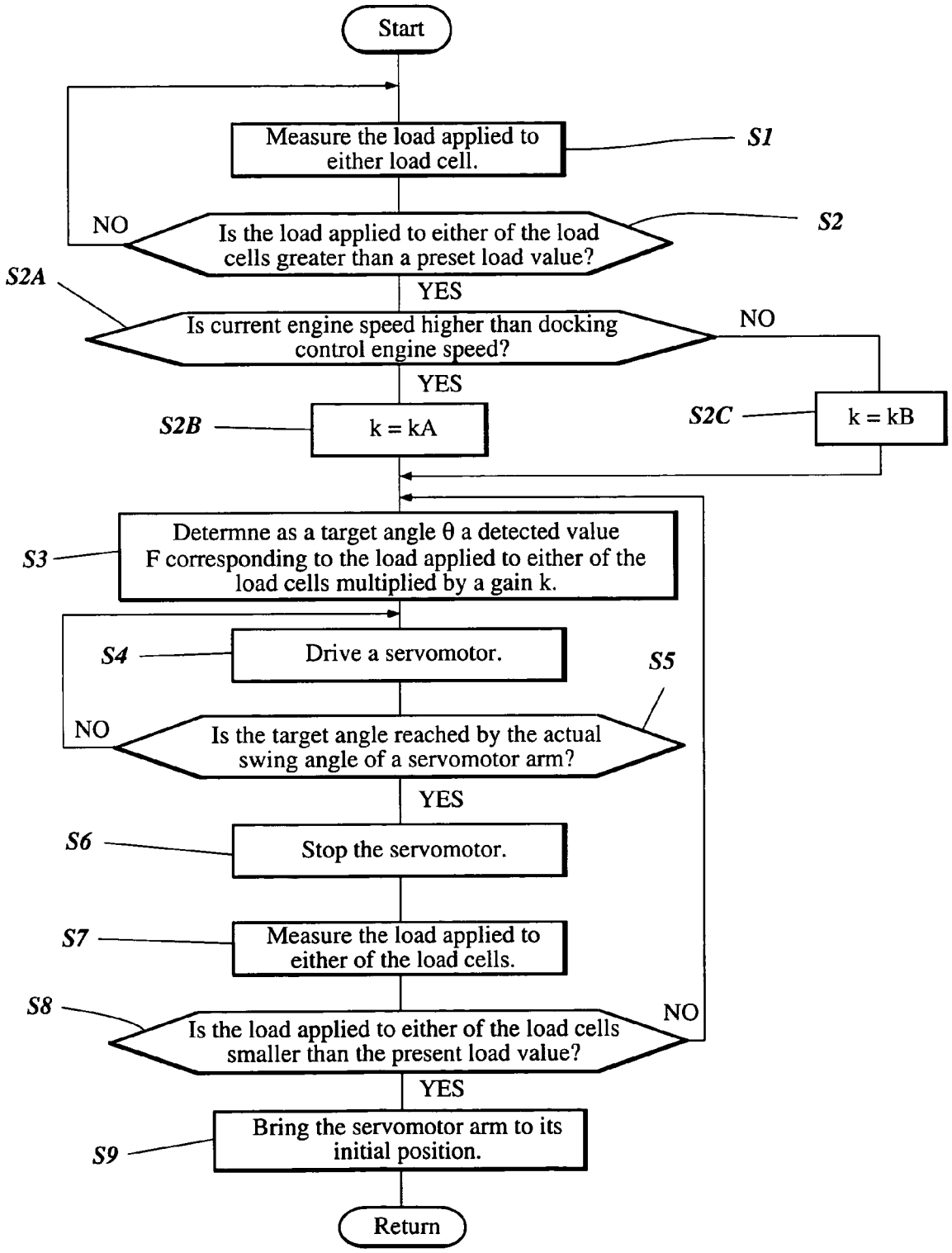
FIG. 5 is an operational flow diagram illustrating a modification of the method of operation of FIG. 4.

FIG. 5 illustrates a modification of the control diagram of FIG. 4. The control method of FIG. 5 is similar to the control method of FIG. 4, except that IN the control method of FIG. 5, the determination of a gain K is dependent upon whether the engine speed is higher than a predetermined docking control engine speed. Accordingly, for the purpose of clarity, identical steps in the control system of FIG. 5 receive the same step number as the corresponding step in the control system of FIG. 4.

The system 32 of FIG. 5 measures the load applied to either load cell 86*a*, 86*b* at step S1. At step S2, the system 32 determines whether the load applied to either of the load cells 86*a*, 86*b* is greater than a preset load value. If the load is less than a preset load value, the system 32 returns to step S1.

However, if the load applied to either of the load cells 86*a*, 86*b* is greater than a preset load value, the system 32 moves to step S2A wherein it is queried whether the current engine speed is higher than a predetermined docking control engine speed. If the answer to the query at step S2A is no, the system moves to step S2C wherein a gain K is calculated as equivalent to a first gain value KB.

The system 32 then proceeds to step S3, wherein a target angle θ is determined by a detected value F corresponding to a load applied to either of the load cells 86*a*, 86*b* and multiplied by the first gain value KB. The system 32 then proceeds through steps S4 to S9, which preferably are substantially identical to the steps of the same number in the control strategy of FIG. 4 and, thus, are not described in further detail.

If the answer to the query at step S2A is yes, that the current engine speed is higher than a docking control engine speed, the system 32 moves to step S2B wherein the gain K is made equivalent to a second gain value KA, which is a relatively higher than the first gain value KB.

From step S2B, the system moves to step S3 wherein a target angle θ is determined as a detected value F corresponding to the load applied to either of the load cells 86*a*, 86*b* multiplied by the second gain value KA. Thus, when the current engine speed is higher than a docking control engine speed, the increase in engine speed corresponding with a detected value F of the load applied to either of the load cells 86*a*, 86*b* is greater than an engine speed produced when the current engine speed is lower than the docking control engine speed. Accordingly, the steering assist force may be commensurate with the present speed of the watercraft 30. From step S3, the system moves through steps S4 through S9 in a manner similar to that of the control system of FIG. 4 and is not further described herein.

Figure 6:
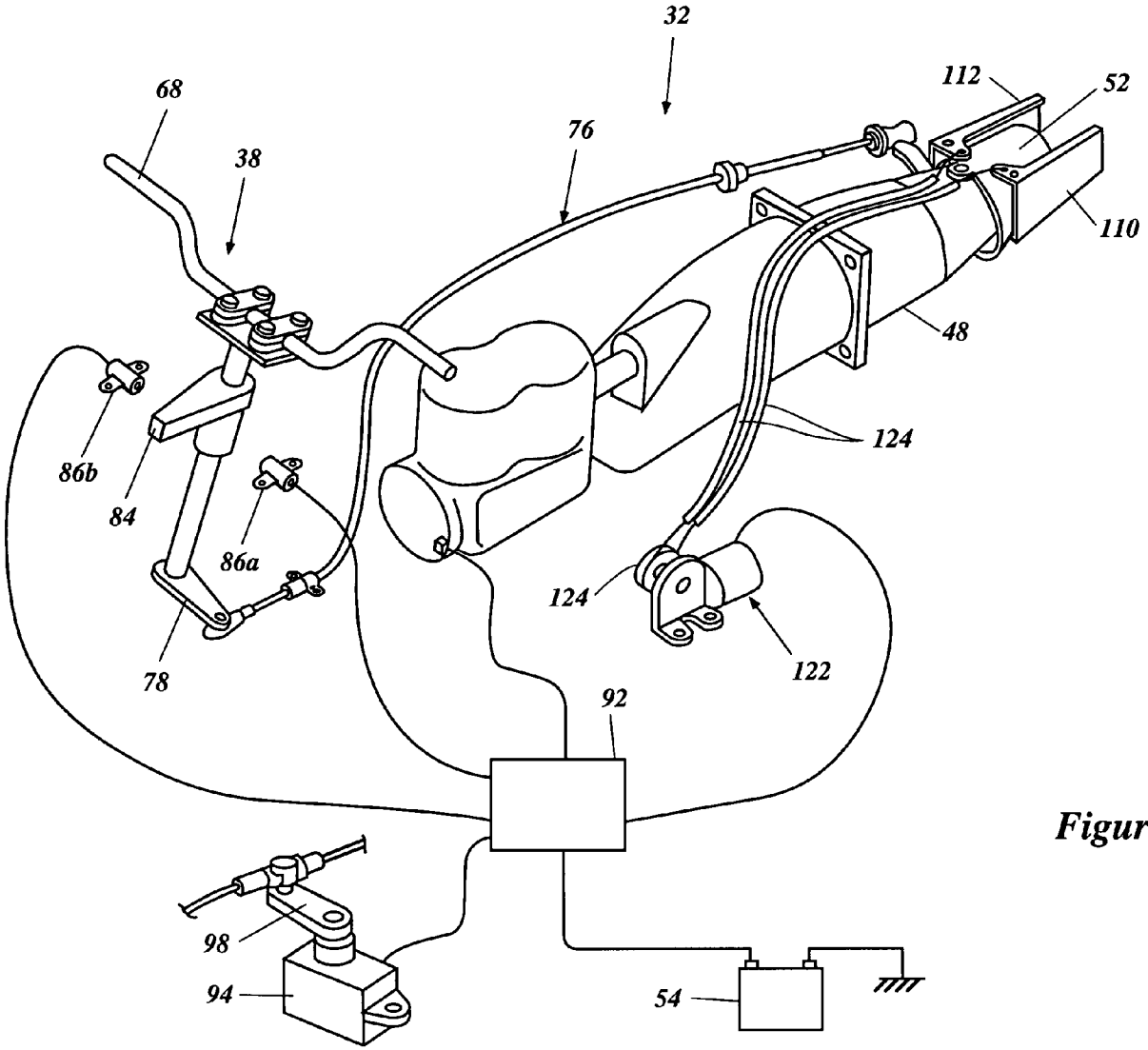
FIG. 6 is a perspective view of the steering assist system of FIG. 2, additionally including a pair of deflectors pivotally supported relative to the steering nozzle of the jet propulsion unit for rotation about a generally vertical access to selectively divert at least a portion of a flow of water issuing from the jet propulsion unit.
Figure 7:
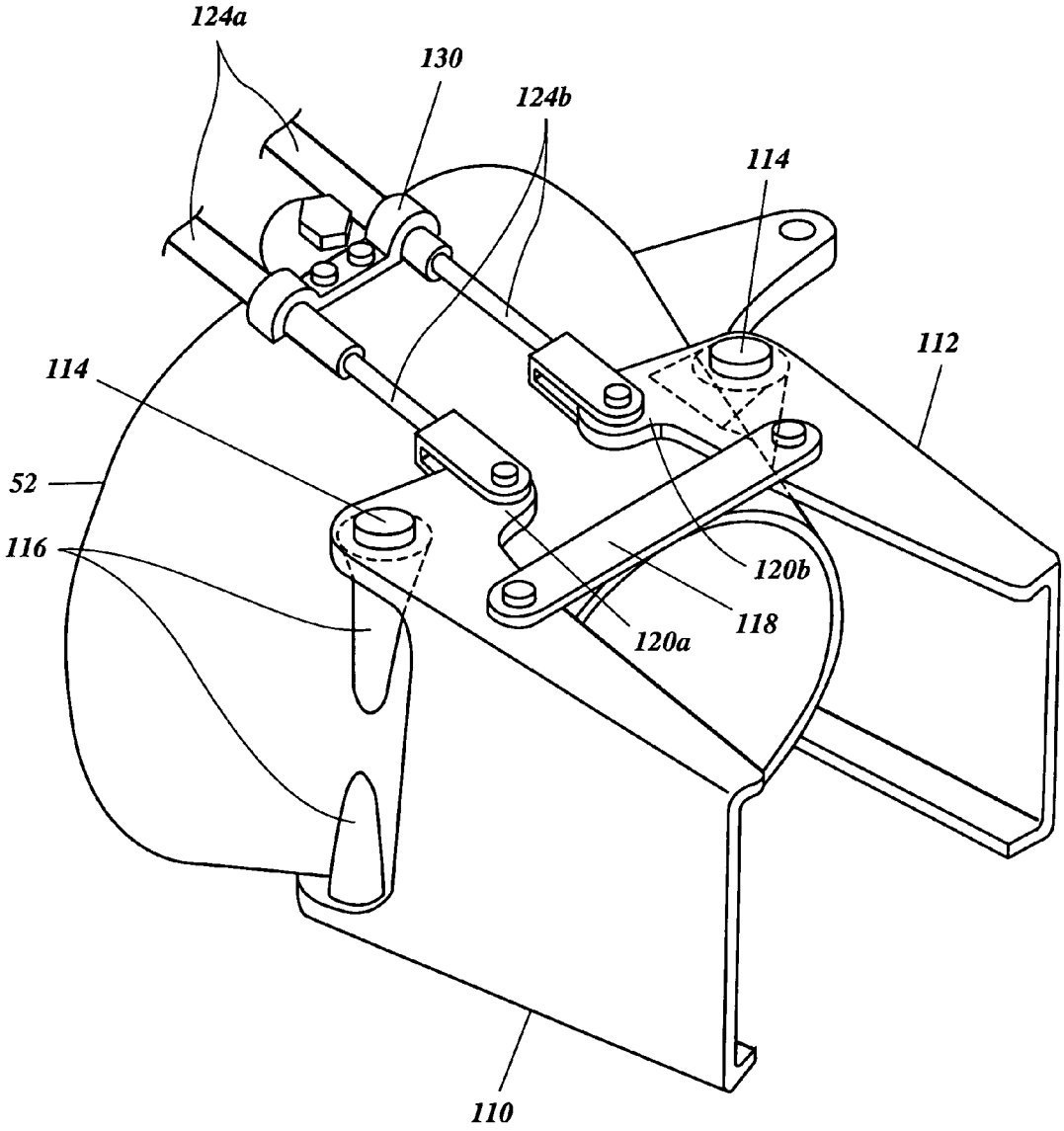
FIG. 7 is an enlarged top, port side, and rear side perspective view of the steering nozzle and pair of deflectors of the steering assist system of FIG. 6.

With reference to FIGS. 6–8, the steering assist system 32 CAN also include a pair of deflector members 110, 112 arranged to selectively divert a flow of water issuing from the steering nozzle 52 to provide a steering assist force to the associated watercraft 30. The deflectors 110, 112 preferably are elongate, plate-like members having a vertical side wall, which extends rearwardly of an outlet of the steering nozzle 52. Upper and lower walls extend from the vertical side wall toward the steering nozzle 52 and are generally normal to the side wall.

A forward end of each deflector 110, 112 is rotatably supported by upper and lower spindles 114, which are received within a boss 116 of the steering nozzle 52. Thus, the deflectors 110, 112 are pivotal about a generally vertical axis, defined by the spindles 114, relative to the steering nozzle 52. In a neutral position of the deflectors 110, 112, the deflectors 110, 112 are generally aligned with an axis of the steering nozzle 52 and, preferably, do not significantly interfere with a flow of water issuing from the steering nozzle 52.

Preferably, the deflectors 110, 112 are coupled for movement with one another. In the illustrated arrangement, a coupling link 118 extends between, and is pivotally coupled to, each of the deflectors 110, 112 and, preferably, to upper walls of each deflector 110, 112. Thus, the coupling link 118 assures that the deflectors 110, 112 rotate in the same direction with respect to an axis of the steering nozzle 52.

Preferably, the upper wall of each of the deflectors 110, 112 includes a portion 120*a*, 120*b*, respectively, which are adapted to permit connection of the deflectors 110, 112 to a servomotor 122 through a Bowden wire assembly 124. In the illustrated arrangement, the portions 120*a*, 120*b* are positioned inwardly of the spindles 114 to increase a leverage of the Bowden wire assemblies 124 on the deflectors 110, 112.

Preferably, a separate Bowden wire 124 is provided for each of the deflectors 110, 112. Each Bowden wire assembly 124 includes a housing 124*a* and an inner wire 124*b* movable within the housing 124*a*. The inner wire 124*b* of each Bowden wire 124 is connected, at a first end, to a pulley 126 of the servomotor 122 and, at the other end, to the portions 120*a*, 120*b* of the deflectors 110, 112, respectively. Preferably, the ends of the housings 124*a* are held in a fixed position by cable stop members, such as cable stop 130 (FIG. 7), which secures one end of the housing 124*a* to the steering nozzle 52.

Thus, rotation of the pulley 126 by the servomotor 122 results in a pulling force applied to one of the inner wires 124*b* and a pushing force applied to the other of the inner wires 124*b*, which causes the deflectors 110, 112 to rotate about an axis of the spindle 114 in the same direction. The servomotor 122 is connected to the controller 92 such that an angular position of the deflectors 110, 112 may be controlled by the steering assist system 32.

Figure 8A:
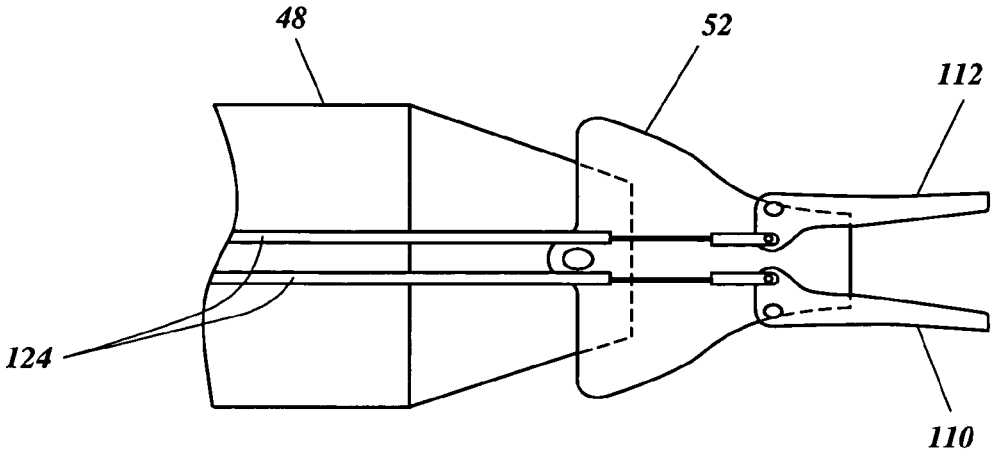
FIG. 8*a* is a top plan view of the steering nozzle in a neutral position and the pair of deflectors in a neutral position relative to the steering nozzle.
Figure 8B:
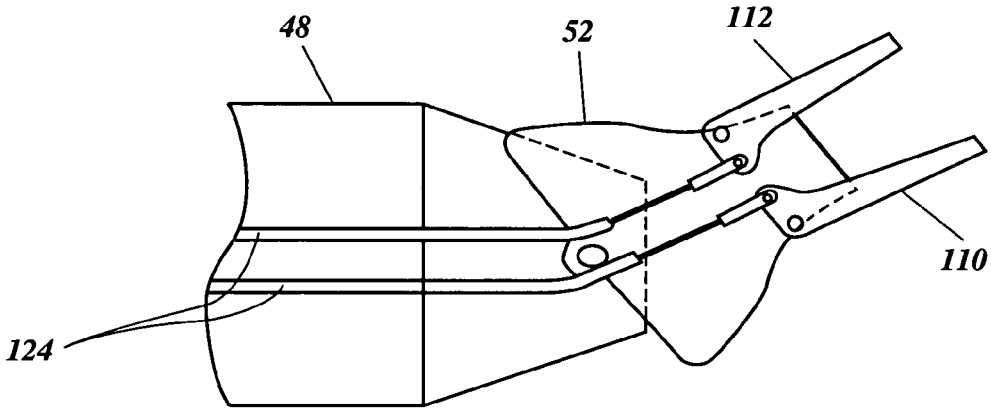
FIG. 8*b* shows the steering nozzle rotated toward the starboard side of the jet propulsion unit with the pair of deflectors in a neutral position relative to the steering nozzle.
Figure 8C:
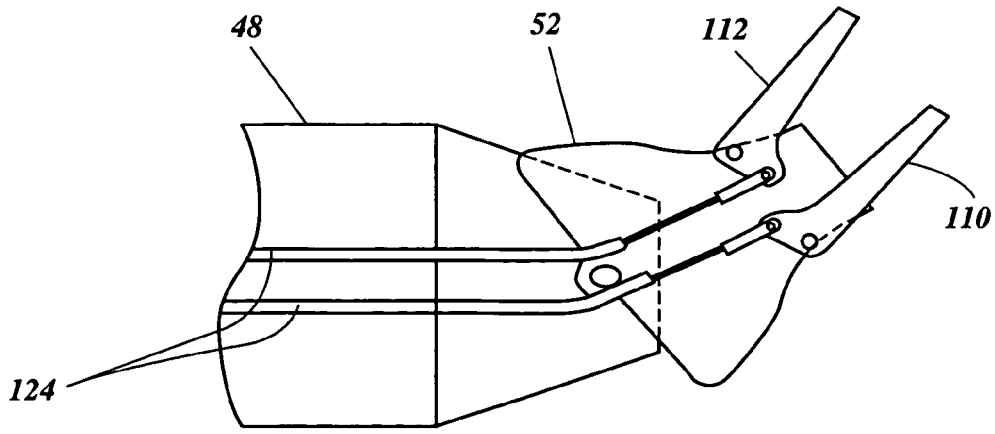
FIG. 8*c* shows the steering nozzle with the pair of deflectors in a rotated position relative to the steering nozzle.

With reference to FIGS. 8*a*–8*c*, the jet pump unit 48, steering nozzle 52 and deflectors 110, 112 are shown in several positions relative to one another. In FIG. 8*a*, the steering nozzle 52 is shown in a neutral position wherein an axis of the steering nozzle 52 is aligned with an axis of the jet pump unit 48. In addition, the deflectors 110, 112 are shown in a neutral position relative to the steering nozzle 52, wherein a plane defined by the vertical wall of each deflector 110, 112 is generally aligned with an axis of the steering nozzle 52. Thus, with the steering nozzle 52 and deflectors 110, 112 in the position generally as illustrated in FIG. 8*a*, the associated watercraft 30 travels in a generally straight path. In addition, preferably, the deflectors 110, 112 do not significantly interfere with a water jet issuing from the steering nozzle 52.

With reference to FIG. 8*b*, the steering nozzle 52 is rotated with respect to the jet pump unit 48 toward a starboard side of the associated watercraft 30, thus providing a steering force tending to move the watercraft 30 in a starboard direction. The deflectors 110, 112 remain in a neutral position relative to the steering nozzle 52. Thus, a "normal" steering force is produced, with no significant steering force provided by the steering assist system 32.

With reference to FIG. 8*c*, the steering nozzle 52 is rotated in a starboard direction with respect to the jet pump unit 48 as in FIG. 8*b*. In addition, the steering assist system 32 has rotated the deflectors 110, 112 in a starboard direction relative to the steering nozzle 52. In the position shown in FIG. 8*c*, the deflectors 110, 112 divert at least a portion of the water issuing from the jet pump unit 48 to create a reactionary steering force tending to move the watercraft 30 in a starboard direction. Such a force produced by the diversion of the water issuing from the steering nozzle 52 by the deflectors 110, 112 is in addition to a steering force produced simply by the rotation of the steering nozzle 52. Accordingly, steer-ability of the watercraft 30 is increased, especially when an output of the jet pump unit 48 is relatively low.

Preferably, the angular position of the deflectors 110, 112 relative to the steering nozzle 52 is controlled by the steering assist system 32 in a manner similar to the control process of FIGS. 4 and 5. That is, preferably, the steering assist system 32 controls an angular position of the deflectors 110, 112 in response to a force applied to the load cells 86*a*, 86*b* as a result of an operator of the watercraft 30 further applying a force to the handlebar assembly 38 after the handlebar assembly 38 has been turned to a maximum turning position. Preferably, the steering assist system 32 adjusts an angular position of the deflectors 110, 112 in proportion to a load applied to either of the load cells 86*a*, 86*b*. In an alternative arrangement, the steering assist system 32 includes the deflectors 110, 112, but does not alter a power output of the propulsion system 44 in response to a load applied to the load cells 86*a*, 86*b*. Thus, in such an arrangement, steering assist is provided by the steering force produced by the deflectors 110, 112 diverting at least a portion of the water jet issuing from the steering nozzle 52 during idle speeds of the engine 46.

Figure 9:
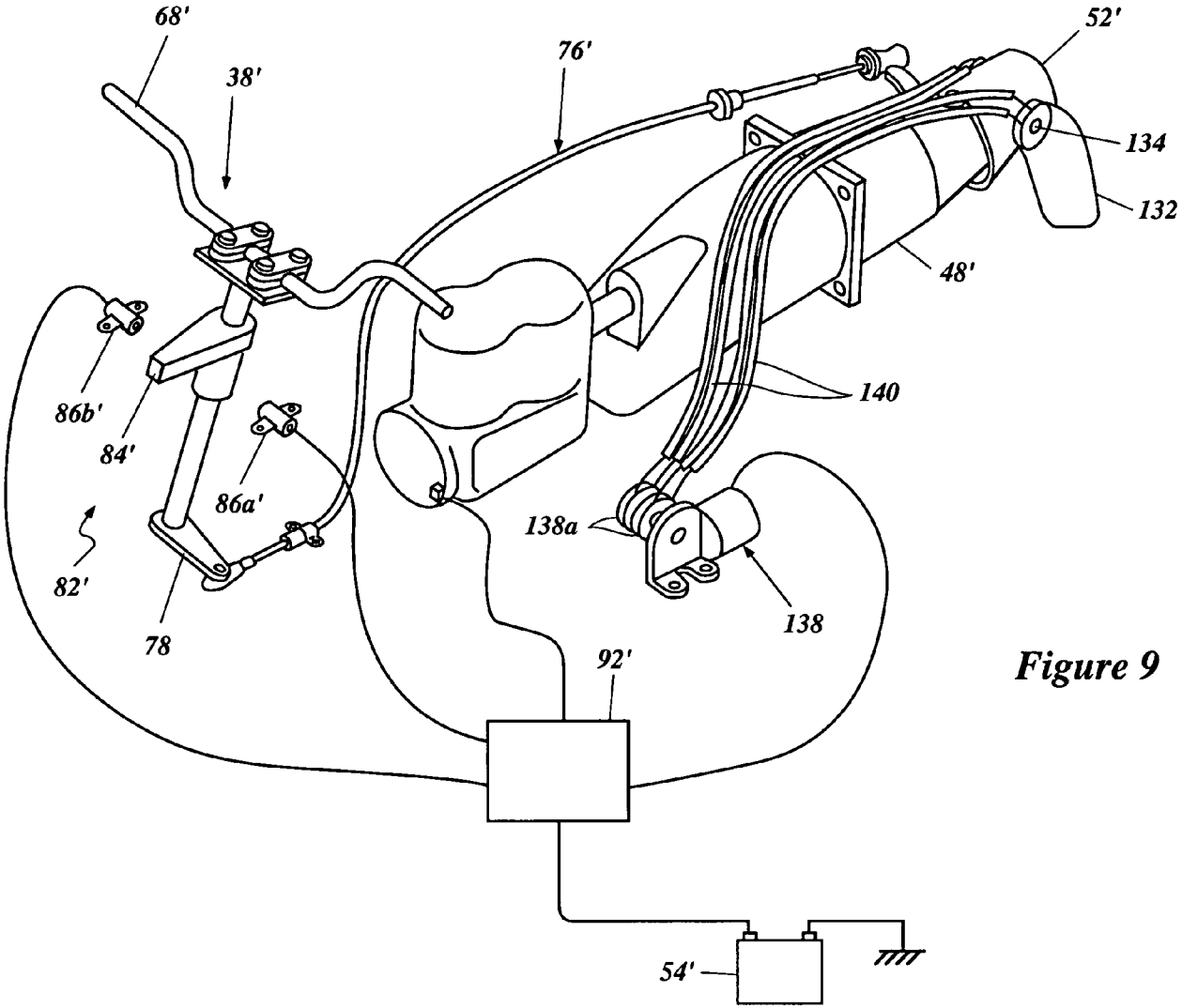
FIG. 9 is a perspective view of a modification of the steering assist system of FIGS. 1–8 and including one or more rudders rotatably supported by the steering nozzle to be rotatable about a generally horizontal axis.
Figure 10:
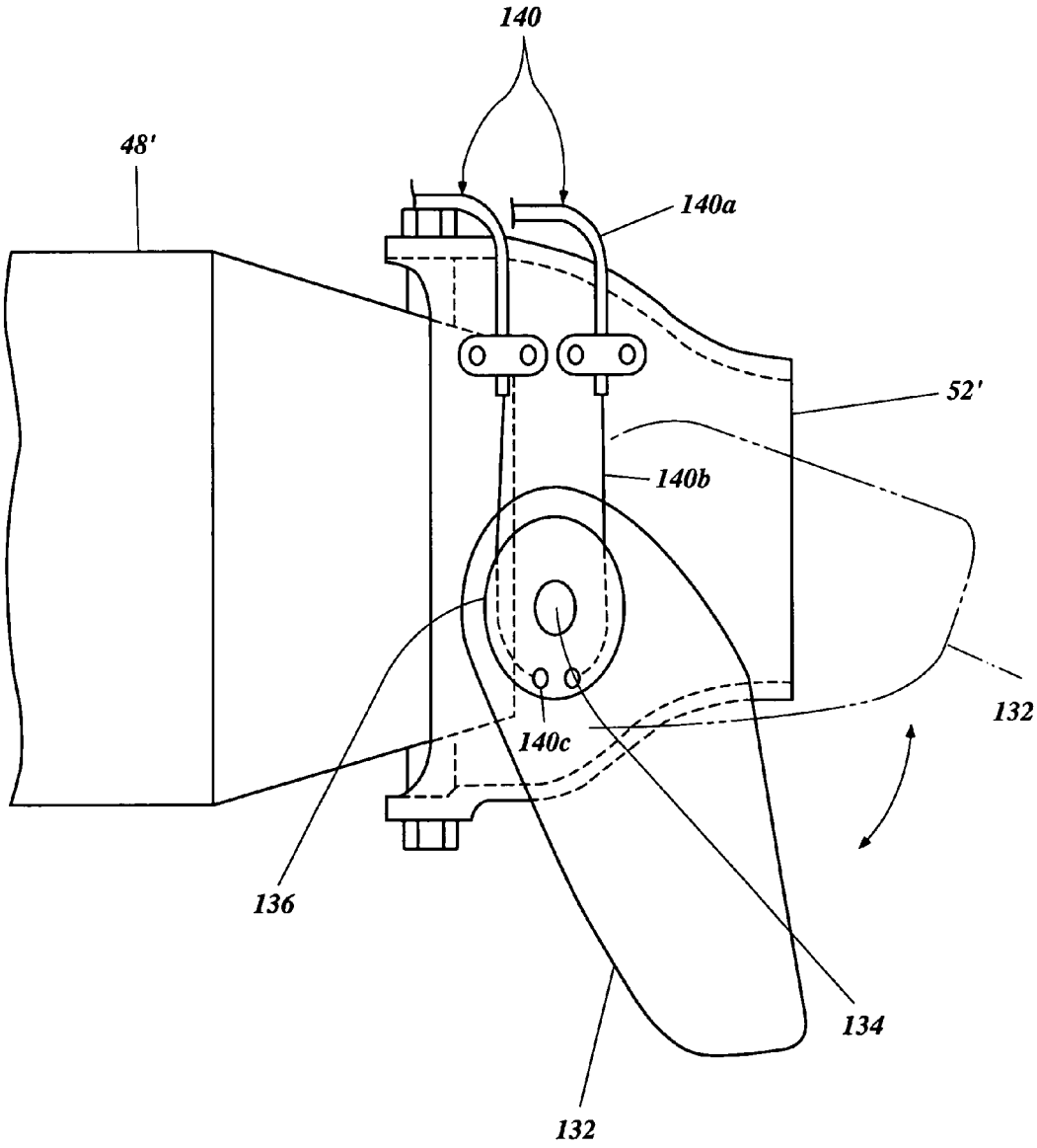
FIG. 10 is an enlarged, elevational view of the steering nozzle of the steering assist system of FIG. 9. The rudder is shown in a raised position in phantom line and a lowered position in solid line.
Figure 11:
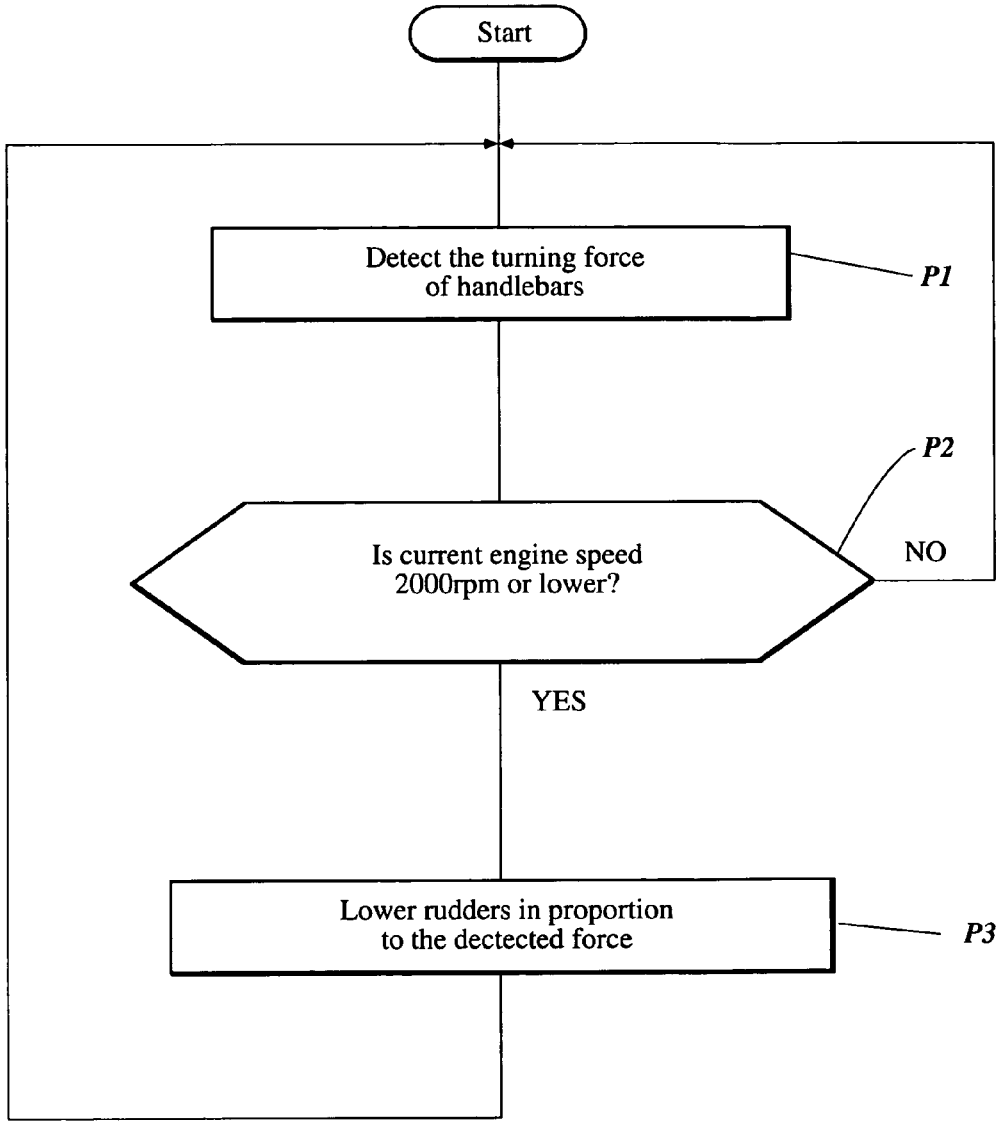
FIG. 11 is an operational flow diagram of a preferred method of operation of the steering assist system of FIG. 9.

With reference to FIGS. 9–11, a modification of the steering assist system 32 of FIGS. 1–8 is illustrated and is generally indicated by the reference numeral 32'. The steering assist system 32' is substantially similar to the steering assist 32' of FIGS. 1–8 and, therefore, like reference numerals are used to denote like components, except that a prime (') is added.

In place of the deflectors 110, 112, the steering assist system 32' includes one or more rudders 132 pivotally supported relative to the steering nozzle 52' by a rudder shaft 134. In the illustrated arrangement, a pair of rudders 132 are provided on each lateral side of the steering nozzle 52. Each rudder 132 includes an associated rudder shaft 134, which supports the rudder 132 for rotation about a generally horizontal axis.

With reference to FIG. 10, each rudder 132 is movable between a raised position (shown in phantom) and a lowered position. Preferably, in the raised position, a lower edge of the rudder 132 does not extend below a lowermost edge of the steering nozzle 52. Accordingly, in the raised position, the rudder 132 preferably does not provide a supplemental steering force, or steering assist force to an associated watercraft. In lowered position of the rudder 132, preferably a substantial portion of the rudder 132 extends below a lowermost edge of the steering nozzle 52'. Thus, when the steering nozzle 52' is rotated relative to the jet pump unit 48', the pair of rudders 132 provide an additional steering force to an associated watercraft.

A pulley 136 of each rudder 132 is connected to a pulley 138*a* of a servomotor 138 by a pair of Bowden wire assemblies 140. Each Bowden wire assembly 140 includes a housing 140*a* and an inner wire 140*b* movable within the housing 140*a*. One end of the inner wires 140*b* are connected to the pulley 136 of the rudder 132 by wire ends 140*c* and the opposite end of the inner wires 140*b* are similarly connected to the pulley 138*a* of the servomotor assembly 138. The inner wires 140*b* are arranged such that rotation of the pulley 136 applies a pulling force to one of the inner wires 140*b* and a pushing force to the other of the wires 140*b*. In response, the rudder 132 is rotated between the raised and lowered position with rotation of the pulley 136 by the servomotor 138.

Similar to the previously described arrangements, a controller 92' of the steering assist system 32' controls rotation of the pulley 136 to control a position of the rudders 132. Preferably, the rudders 132 move from the raised position toward the lowered position at an angular displacement related to a load applied to either of the load cells 86*a*', 86*b*' of the steering regulator assembly 82' and, thus, proportional to a force further applied to the operator steering control 38' by an operator of the associated watercraft.

In the illustrated arrangement, an output of the propulsion system 44' is not altered in response to a force applied to either of the load cells 86*a*', 86*b*'. However, in alternative arrangements a power output of the propulsion system 44' may be increased along with the rotation of the rudders 132 toward their lowered position. Furthermore, preferably in the illustrated embodiment, the rudders 132 are rotated toward their lowered position only if a current speed of the engine 46' is below a predetermined threshold engine speed, such as 2000 revolutions per minute (rpm), for example. However, in other arrangements, the rudders 132 may be lowered at higher engine speeds to provide a steering assist force at higher speeds of the associated watercraft.

With reference to FIG. 11, a preferred control strategy for the steering assist system 32' shown in FIGS. 9 and 10 is illustrated. The control strategy starts at a start block and moves to step P1, wherein a force applied to either of the load cells 86*a*', 86*b*' is determined. The system then moves to step P2 where it is queried whether the current engine speed is below a predetermined threshold speed, such as 2000 rpm or lower. If the answer to the query at step P2 is no, the system 32' returns to the beginning and proceeds to P1.

On the other hand, if the current engine speed is lower than the predetermined threshold speed, the system 32' moves to step P3, wherein the rudders 132 are moved toward their lowered position. As described above, preferably the rudders 132 are rotated toward their lowered position in proportion to a load applied to either of the load cells 86*a*', 86*b*'. The system 32' then returns to the beginning of the control strategy and monitors for a force above a predetermined threshold further applied to the handlebar member 68' after the handlebar member 68' is turned to a maximum turning position.

Figure 12:
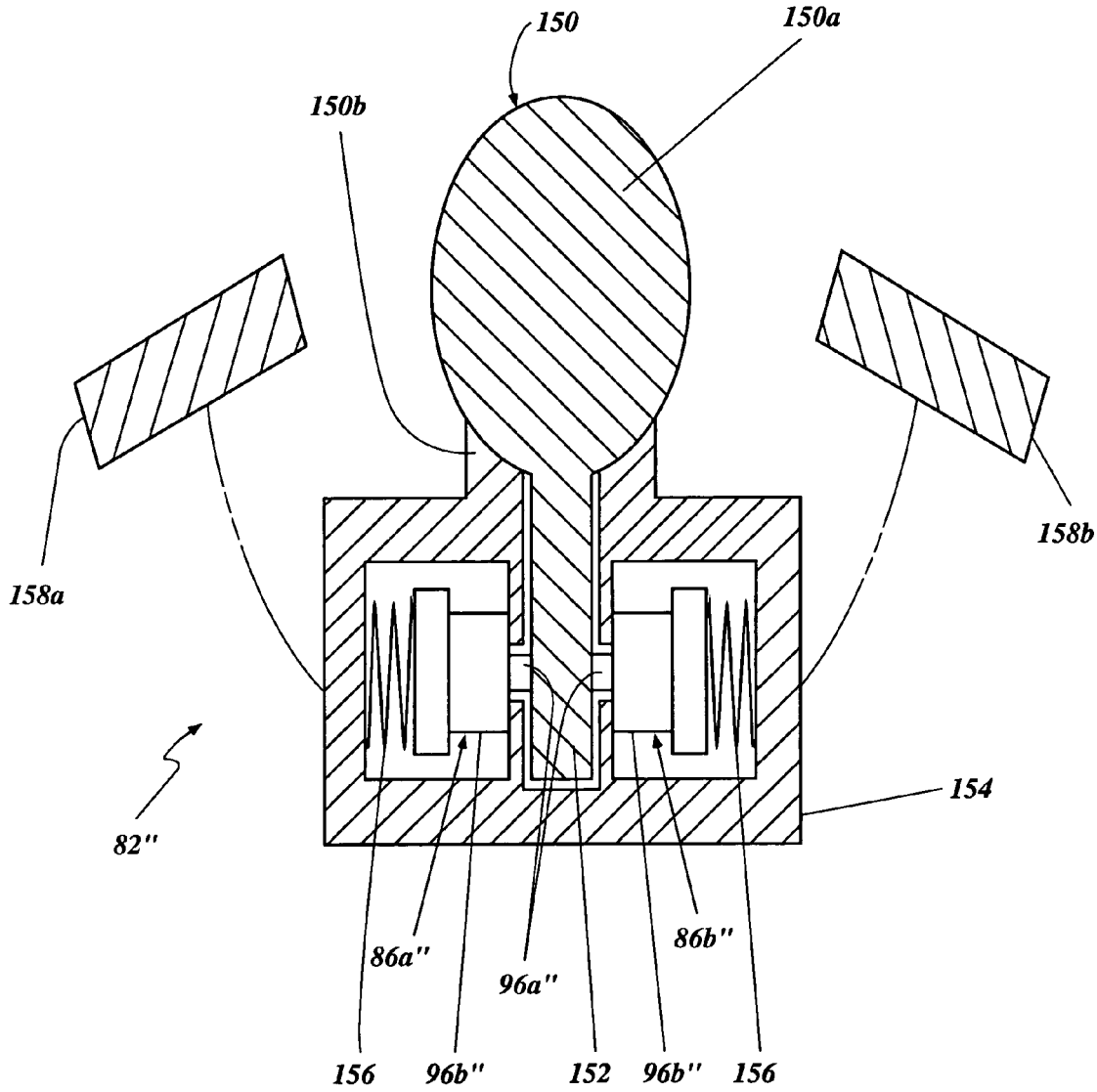
FIG. 12 is a horizontal cross-section of a modification of the force detection assembly of FIGS. 1–11.

With reference to FIG. 12, a modification of the steering regulator assembly 82 shown in FIG. 9 is illustrated, and is generally referred to by the reference numeral 82". Because the steering regulator assembly 82" is similar to the steering regulator assembly 82', like reference numerals are used to denote like components, except that a double prime is added.

The steering regulator assembly 82" includes a steering shaft 150 segmented into an upper steering shaft portion 150*a* and a lower steering shaft 150*b*. The upper steering shaft portion 150*a* includes a radially extending arm 152. The lower steering shaft portion 150*b* includes a housing 154, into which the arm 152 extends. Load cells 86*a*" and 86*b*" are disposed within the housing 154 on opposing sides of the arm 152. Each of the load cells 86*a*", 86*b*" include a load receiving element 96*a*" and a sensor 96*b*". Preferably, each of the load cells 86*a*", 86*b*" are configured in a similar manner as the load cells 86*a*, 86*b* described above. That is, preferably the load cells 86", 86*b*" are of a magnetostrictive type.

Preferably, a biasing member, or spring 156, is interposed between each of the load cells 86*a*", 86*b*" and a lateral side wall of the housing 154 on an opposite side of the load cell 86*a*", 86*b*" opposite the arm 152. Thus, the springs 156 cushion forces applied to the load cells 86*a*", 86*b*" applied by the arm 152. Accordingly, damage to the load cells 86*a*", 86*b*" may be inhibited and, therefore, the useful life of the load cells 86*a*", 86*b*" is increased.

A pair of fixed stop members 158*a*, 158*b* are arranged to limit rotational motion of the steering shaft 150 in a port side direction and a starboard direction, respectively. Thus, the fixed stop members 158*a*, 158*b* define maximum turning positions of the steering shaft 150. When an operator of the associated watercraft rotates the operator steering control 38" toward a starboard side of the watercraft, the steering shaft 150 is rotated such that, eventually, the housing 154 contacts the fixed stop 158*a*. When the operator further rotates the operator steering control 38" in a starboard direction, the upper portion 150*a* of the steering shaft 150 tends to rotate relative to the lower portion 150*b* of the steering shaft 150 and applies a load to the load cell 86*a*". The load cell 86*a*" is configured to produce an output signal corresponding to a load applied to the load cell 86*a*".

As described above, the steering assist system 32" utilizes the output signal of the load cell 86*a*" to provide a steering assist force to the watercraft 30", such as by increasing an output of the propulsion system 44" and/or lowering the rudders 132", for example. In an alternative arrangement, the steering assist force may be provided by a pair of deflectors, such as the deflectors 110, 112 described with respect to FIGS. 6 through 8. The operation of the steering assist system 32" is similar when an operator rotates the operator steering control 38" in a port side direction until the housing 154 contacts the fixed stop 158*b*.

Figure 13:
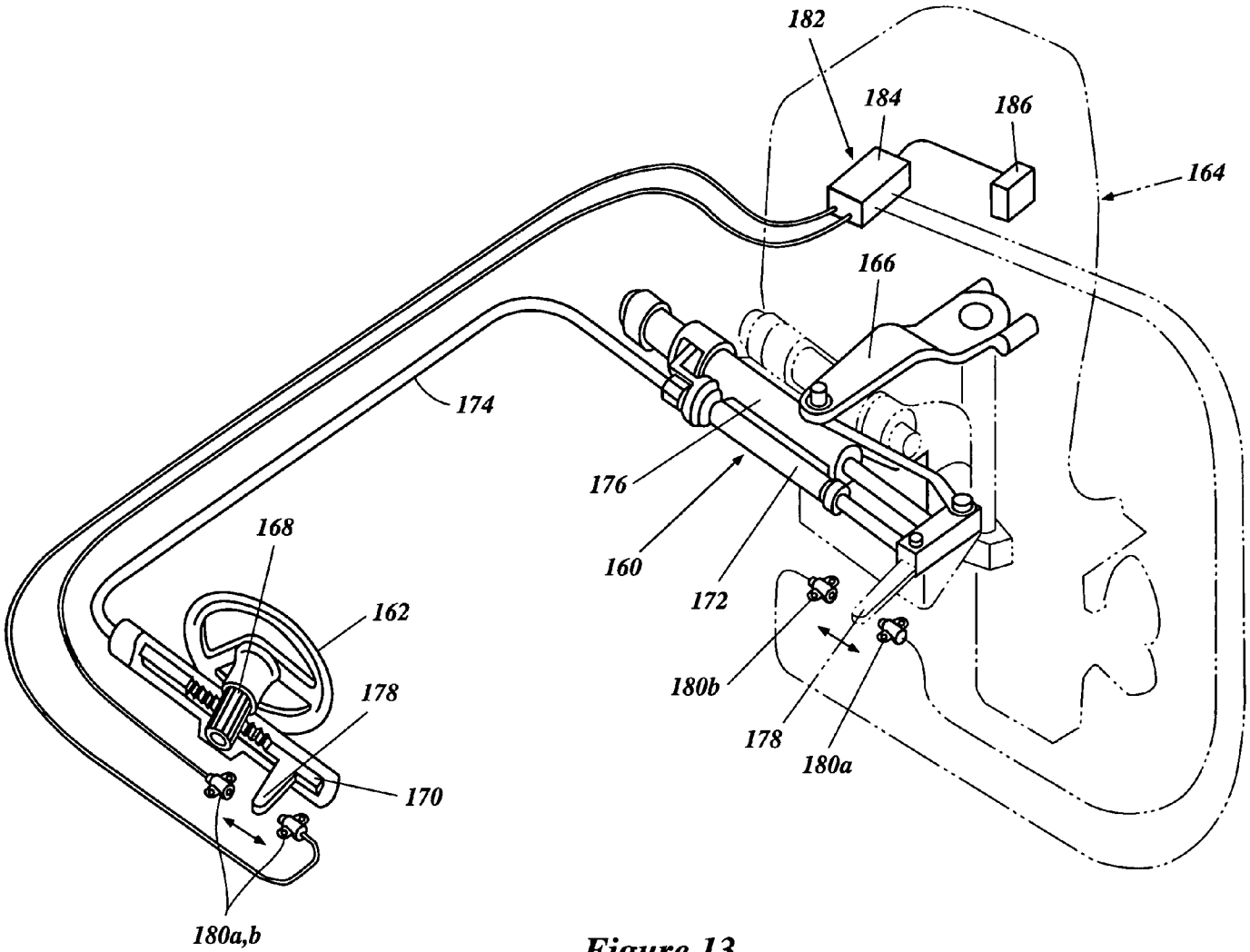
FIG. 13 is a modification of the steering assist system of FIGS. 1–3, adapted for use with a watercraft employing an outboard motor.

As mentioned previously, the steering assist system may also be adapted for use with watercraft utilizing a propulsion system other than a jet pump unit, such as an inboard or outboard motor that rotatably drives a propeller. With reference to FIG. 13, a steering system 160 includes a steering wheel 162 configured to rotate an outboard motor 164 about a generally vertical axis to change the direction of travel of a related watercraft (not shown).

The outboard motor 164 includes a steering arm 166 that, when rotated, turns the outboard motor 164 about a vertical axis. The steering wheel 162 is configured to rotate a pinion 168 along with rotation of the steering wheel 162 to move a rack 170 between a first maximum turning position and a second maximum turning position. The rack 170 is coupled to a first cylinder 172 by a cable 174. Rotation of the steering wheel 162 results in linear motion of the rack 170 which, in turn, results in movement of a shaft of the first cylinder 172.

The first cylinder 172 is coupled to a second, or steering cylinder, 176 such that movement of the shaft of the first cylinder 172 results in movement of the shaft of the steering cylinder 176. Movement of a shaft of the steering cylinder 176 results in rotation of the steering arm 166, which rotates the outboard motor 164 to steer an associated watercraft.

A movable stop arm 178 is carried by the rack 170 to be movable between a pair of fixed stops 180*a*, 182*b*, which define maximum turning positions of the steering system 160. In the illustrated embodiment, the fixed stops 180*a*, 180*b* are load cells configured to produce an output signal related to a load applied to the load cells 180*a*, 180*b* by the movable stop arm 178, in a manner similar to the embodiments described above.

Thus, the steering system 160 includes a steering assist system 182 wherein a controller 184 receives an output signal from one of the load cells 180*a*, 180*b* and is configured to increase an output of the outboard motor 164 in response to an output signal of the load cells 180*a*, 180*b* by a throttle servomotor assembly 186. Preferably, the steering assist system 182 increases an output of the outboard motor 164 in proportion to a load applied to one of the load cells 180*a*, 180*b*.

FIGS. 14 through 17 illustrate a modification of the force detection assemblies of FIGS. 1 through 13 and is generally indicated by the reference numeral 200. The force detection assembly 200 includes a steering shaft 202, which carries a movable stop 204. The movable stop 204 includes a first arm portion 204*a* and a second arm portion 204*b*. Preferably, the first arm portion 204*a* extends in a generally radially in a port side direction from the steering shaft 202. Similarly, the second arm portion 204*b* extends generally radially in a starboard side direction from the steering shaft 202. In the illustrated embodiment, the movable stop arm 204 is a monolithic structure incorporating both the first and second arm portions 204*a*, 204*b*.

The force detection assembly 200 also includes a fixed stop 206 configured to contact each of the first and second arm portions 204*a*, 204*b*. Thus, the fixed stop 206 limits rotation of the steering shaft 202 to define maximum turning positions of the steering shaft and a related operator steering control (not shown). Preferably, the fixed stop 206 includes a pair of load cells 206*a*, 206*b* configured to produce an output signal corresponding to a load placed on the load cells 206*a*, 206*b* by the movable stop 204. The output of the load cells 206*a*, 206*b* may be used by the force detection assembly 200 to permit control of a steering assist system, similar to the embodiments described above.

Preferably, the fixed stop 206 includes a housing 208 fixed to a mounting plate 210, which surrounds the steering shaft 202 and is fixed relative to a hull of an associated watercraft (not shown). The housing 208 may be coupled to the mounting plate 210 by one or more fasteners, such as bolts 212, 214.

Each load cell 206*a*, 206*b* preferably includes a load receiving element 216 and a sensor 218. Preferably, the load receiving element 216 and sensor 218 are similar in construction and function to the load receiving element and sensors described above. That is, the sensors 218 are configured to produce an output signal in response to deformation of the load receiving element 216 due to a load placed thereon by the movable stop 204.

Figure 14:
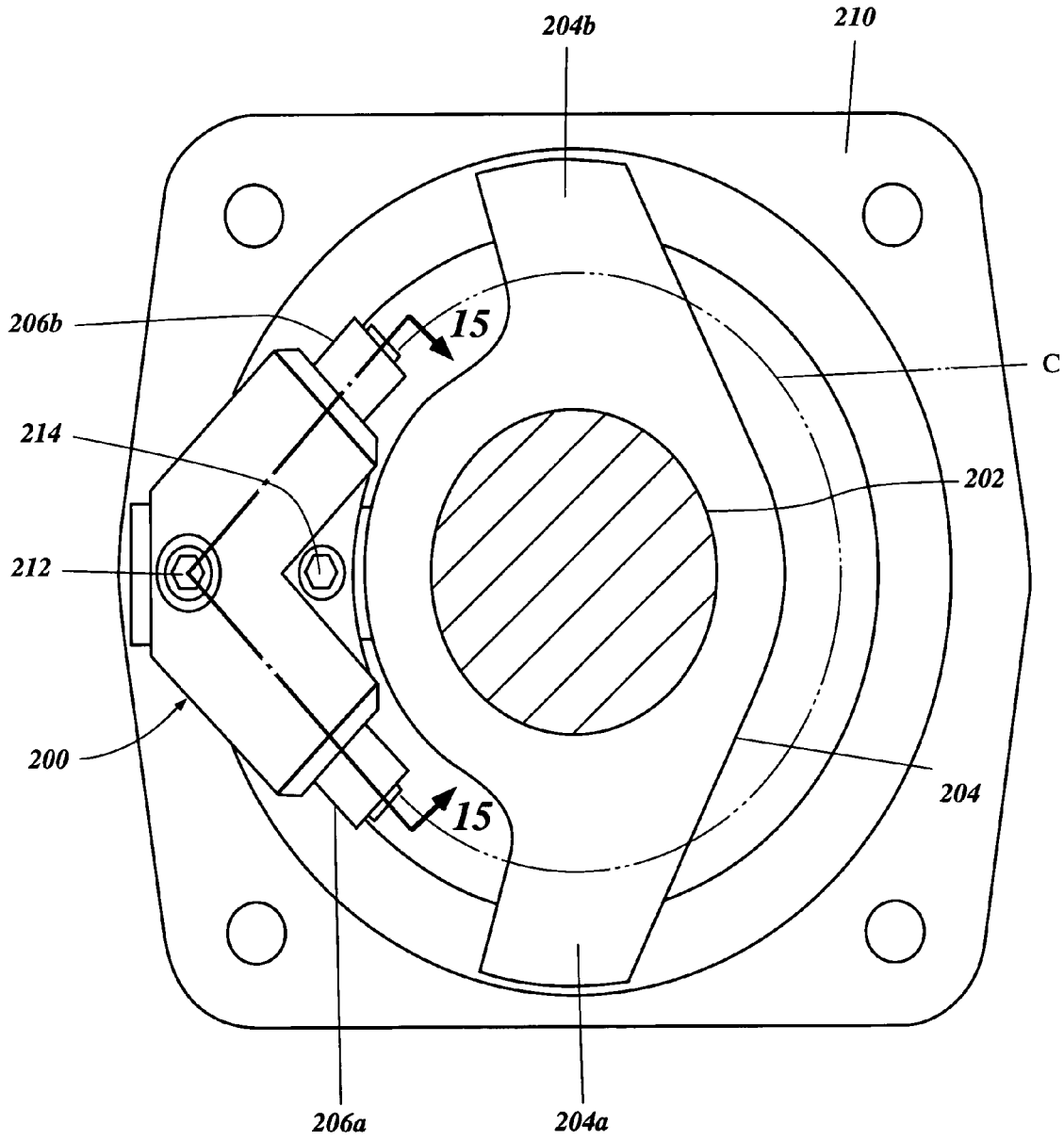
FIG. 14 is a top plan view of a modification of the force detection assembly of FIGS. 1–13. The force detection assembly of FIG. 14 includes one or more sensors provided within an integral housing.

As illustrated in FIG. 14, preferably the load cells 206*a*, 206*b* are arranged such that axes of the load receiving elements 216 cooperate to form a V-shape when viewed from above along an axis of the steering shaft 202. Preferably, the load receiving elements 216 each define a contact surface 220 at their exposed ends opposite the intersection of their axes. Preferably, the surfaces of the first and second arm portions 204*a*, 204*b* that face the contact surfaces 220 of the load receiving elements 216, trace a circular path when rotated about an axis of the steering shaft 202. Thus, a travel path of the surfaces of the first and second arm portions 204*a*, 204*b* that face the contact surfaces 220 creates an imaginary circle centered about an axis of the steering shaft 202. Desirably, the axis of the load receiving elements 216 are substantially tangential to the imaginary circle defined by the first and second arm portions 204*a*, 204*b*. As a result, a load applied to the load receiving elements 216, by the movable stop 204 is substantially aligned along the respective axis of the load receiving elements 216.

Figure 15:
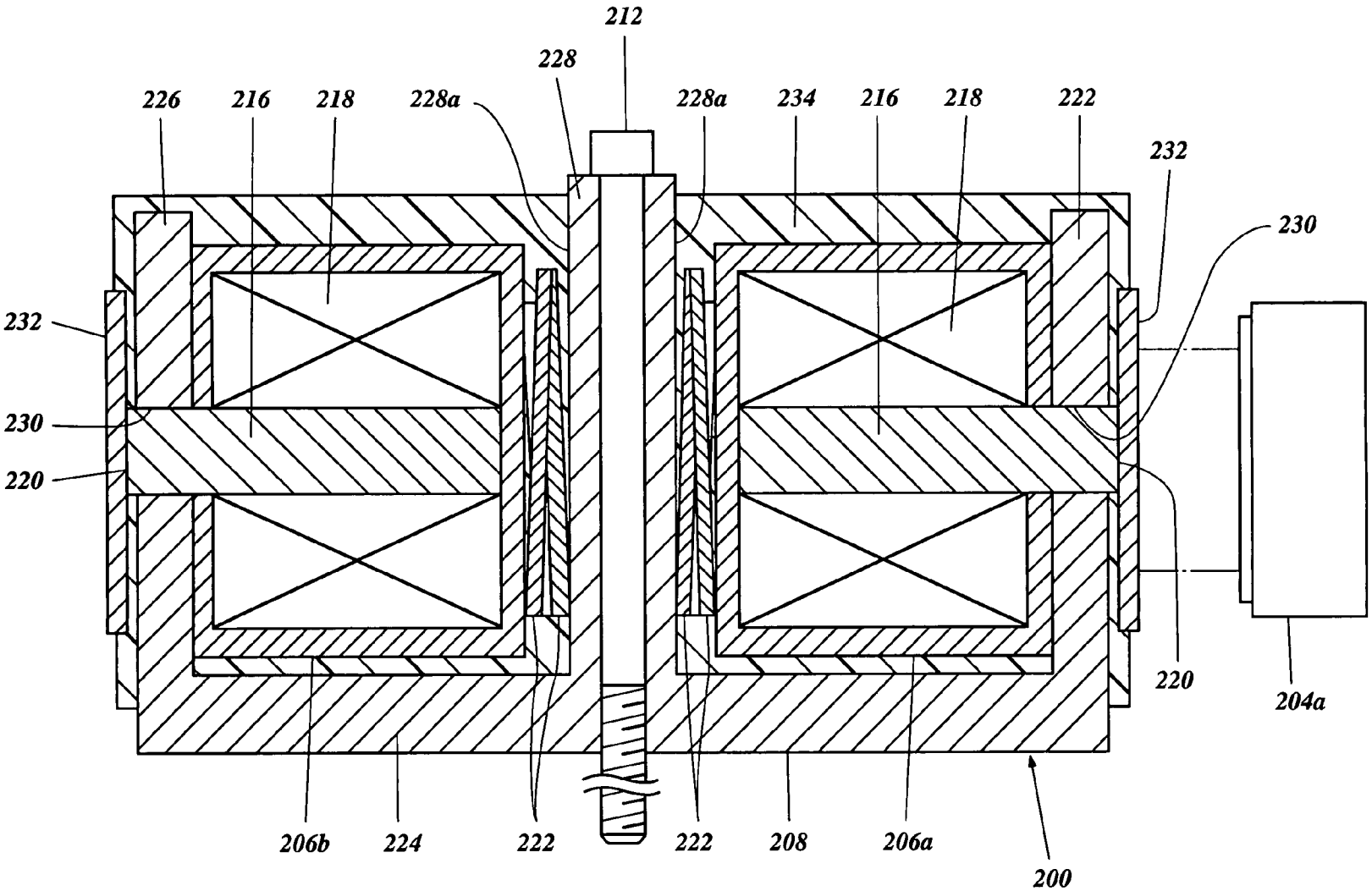
FIG. 15 is a cross-sectional view of the force detection assembly of FIG. 14, taken along line 15—15 of FIG. 14.
Figure 16:
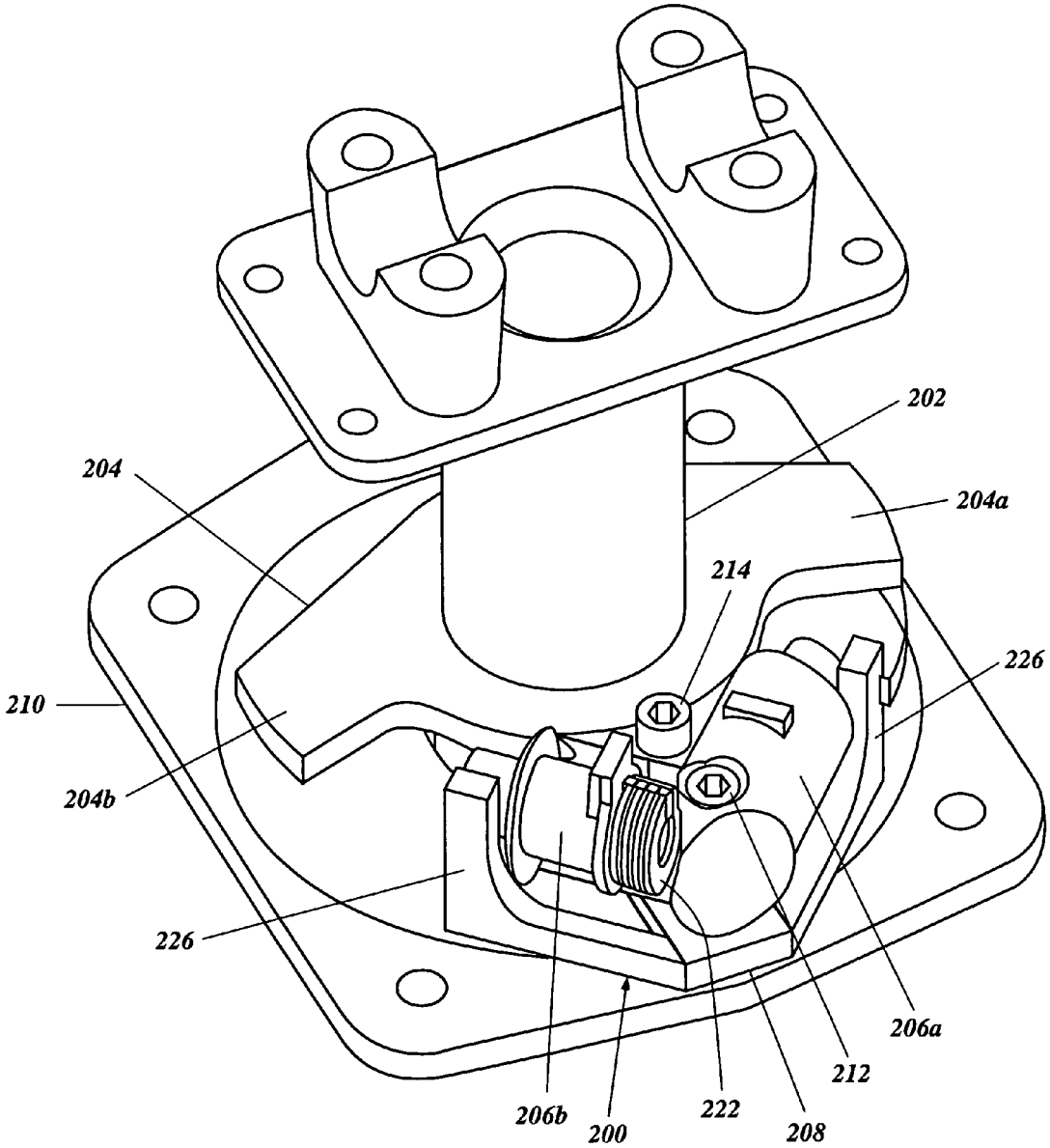
FIG. 16 is a perspective, partial cut-away view of the force detection assembly of FIG. 14.

With reference to FIGS. 15 and 16, a disc spring 222 is interposed between each load cell 206*a*, 206*b* and the housing 208 on a side of the load cells 206*a*, 206*b* opposite the contact surfaces 220 of the load receiving elements 216. The disc springs 222 cushion the load cells 206*a*, 206*b* from abrupt forces applied by the movable stop arm 204.

Desirably, the housing 208 includes a bottom wall 224 and a pair of vertical walls 226 extending upwardly from the bottom wall 224. The housing 208 also includes a central wall 228 defining a surface 228*a* which supports the disc springs 222 against a load applied to the load cells 206*a*, 206*b* and the disc springs 222 by the movable stop arm 204. Portions of the vertical wall 226 opposite the central wall 228 (through which the legs of the V pass) each define a through hole 230 sized and shaped to permit the load receiving element 216 to pass therethrough.

Figure 17:
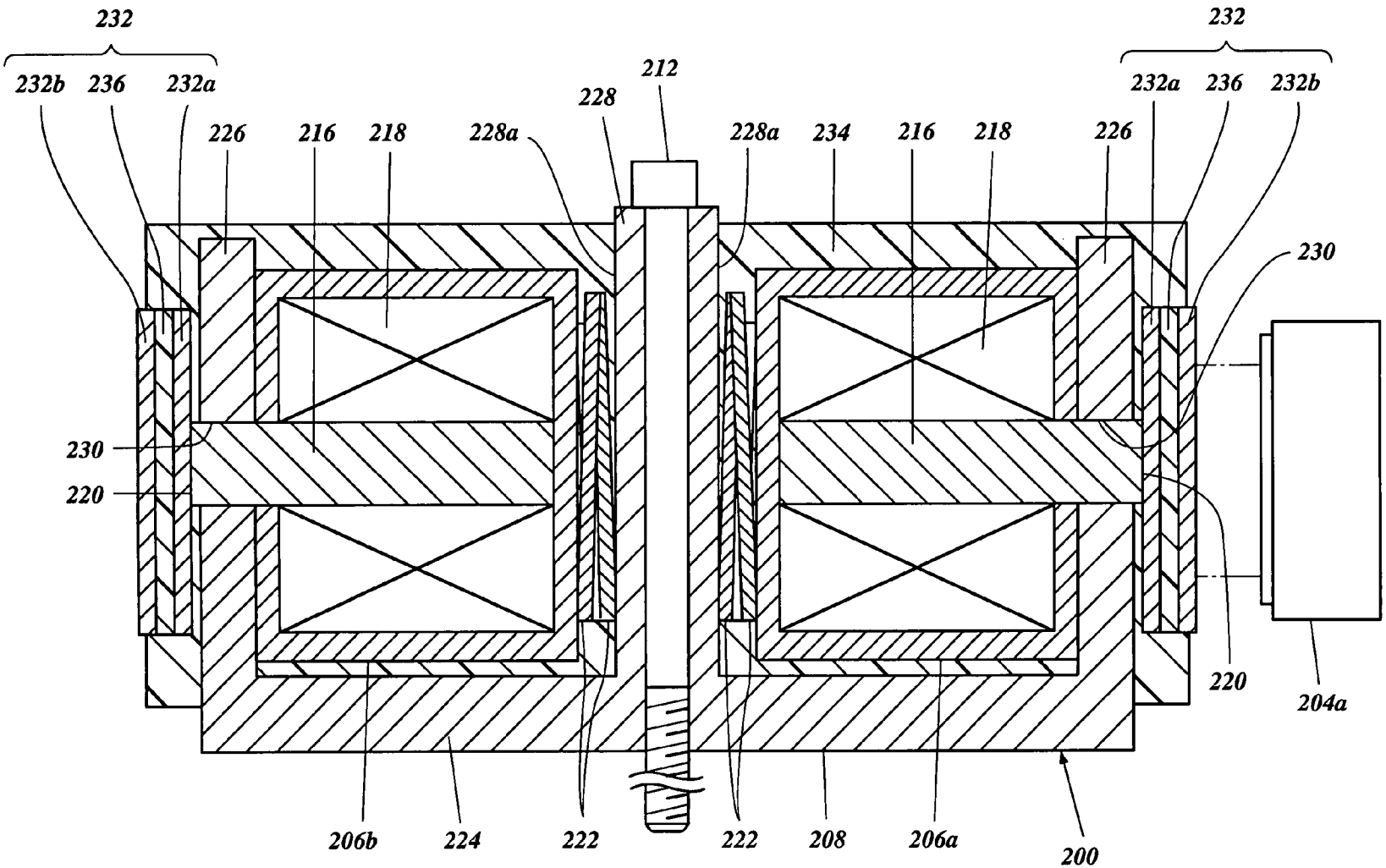
FIG. 17 is a cross sectional view of a modification of the force detection assembly of FIG. 14.

Preferably, an intermediate plate 232 is interposed between the movable stop arm 204 and the contact surfaces 220 of the load receiving elements 216 to protect the contact surfaces 220 from damage, as illustrated in FIG. 15. In one arrangement, the intermediate plate 232 may comprise an assembly of a pair of plate members 232*a*, 232*b* separated by a shock absorbing member 236, as illustrated in FIG. 17.

Such an arrangement, further inhibits abrupt forces from damaging the load receiving elements 216.

Desirably, the integral housing 208 does not include an upper wall, but rather is closed by an elastically-deformable sealing resin 234. The resin 234 preferably is applied to the top of the housing 208 and penetrates an interior surface of the housing 208 not occupied by other components therein, such as the load cells 206*a*, 206*b* and disc springs 222. Accordingly, the load cells 206*a*, 206*b* are insulated from damage due to vibrations, moisture or the like.

Figure 18:
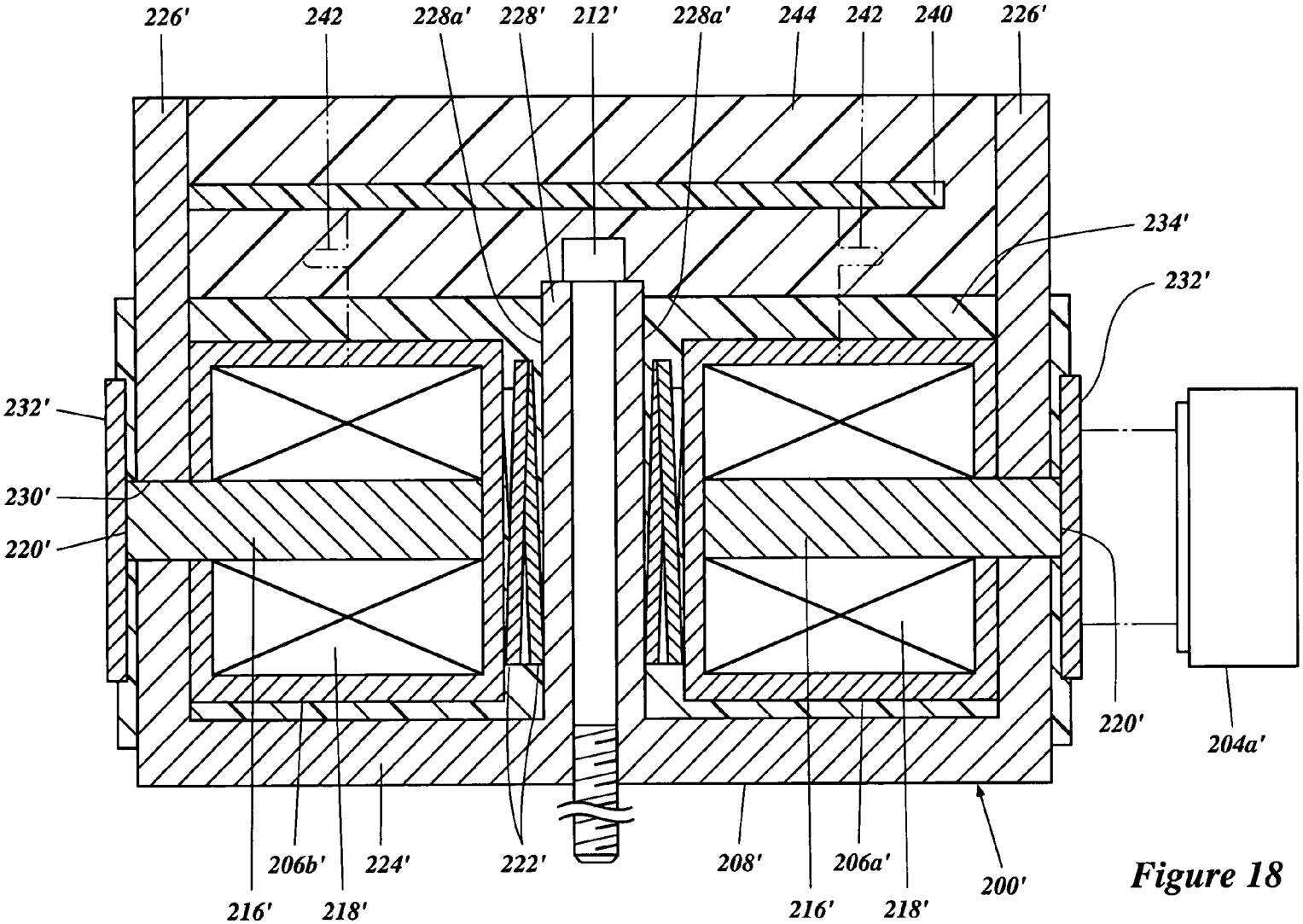
FIG. 18 is a cross-sectional view of a modification of the force detection assembly of FIG. 14 and further including an electric circuit board sealed within the integral housing.
Figure 19A:
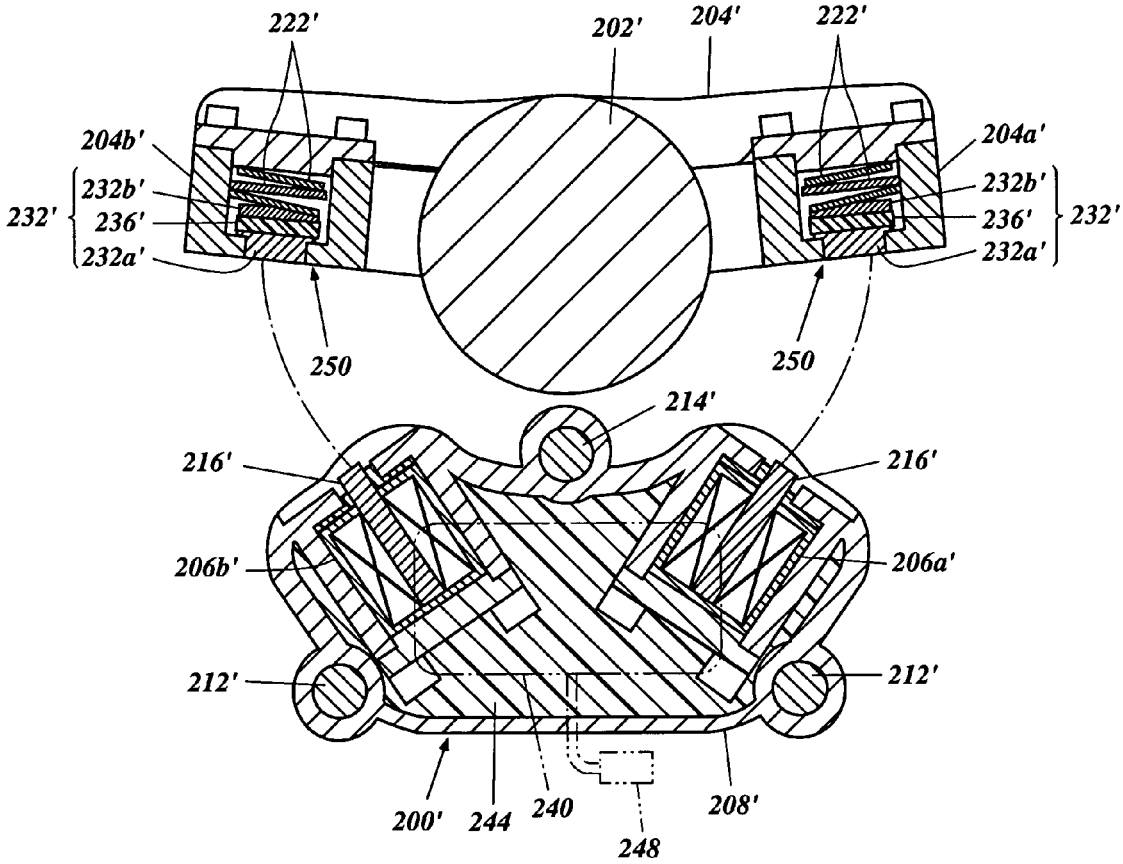
FIG. 19*a* is a horizontal cross-section of a modification of the force detection assembly of FIG. 18.
Figure 19B:
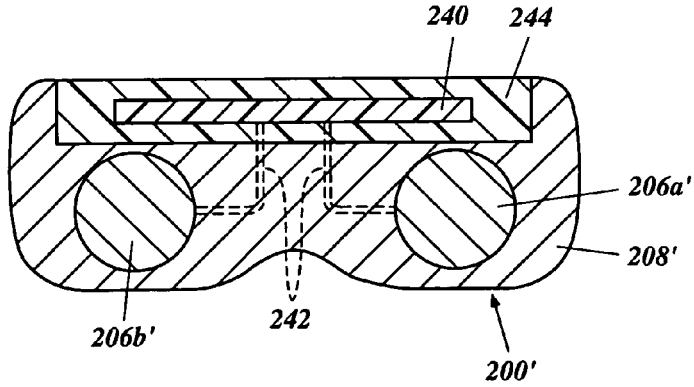
FIG. 19*b* is a vertical cross-section of the integral housing of the force detection assembly of FIG. 19*a*.
Figure 20:
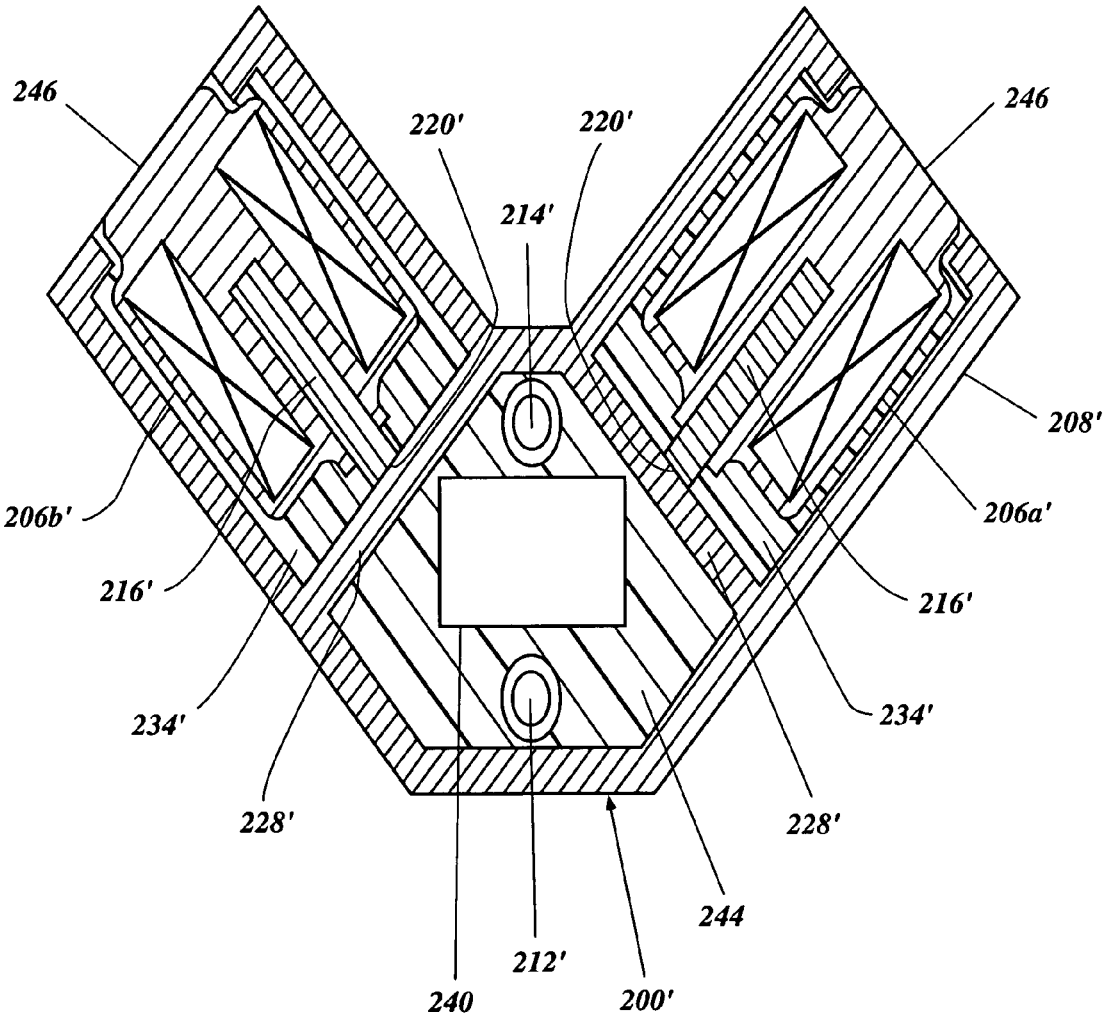
FIG. 20 is a horizontal cross-section of a modification of the force detection assembly of FIG. 18.

With reference to FIGS. 18 through 20, a modification of the force detection assembly 200 of FIGS. 14 through 17 is illustrated and is generally referred to by the reference numeral 200'. The force detection assembly 200' is substantially similar to the force detection assembly 200 and, therefore, like reference numerals will be used to denote like components, except that a prime (') is added.

The force detection assembly 200' is similar to the force detection assembly 200 of FIGS. 14 through 17, except that the force detection assembly 200' includes an electronic circuit board 240 within the housing 208'. The electronic circuit board 240 may include an amplifier circuit to amplify an output signal of the load cells 206*a*', 206*b*', for example. The electronic circuit board 240 is electrically connected to the sensors 218' by leads 242.

The circuit board 240 preferably is suspended within a shock absorbing material 244, such as silicon gel, for example, in a position above the sealing resin 234'. Preferably, the vertical wall 226' of the housing 208' extends upwardly to at least a top surface of the shock absorbing material 244. Accordingly, the circuit board 240 is adequately supported and generally isolated from moisture, temperature changes, abrupt forces and the like. A connector assembly 248 may be electrically connected to the circuit board 240 and extend externally of the housing 208' to permit the circuit board 240 to be connected to external components, such as a controller (not shown) for example.

Another difference between the force detection assembly 200' and the force detection assembly 200 of FIGS. 14 through 17 is that shock absorbing arrangements 250 are provided on the movable stop 204'. Preferably, a shock absorbing arrangement 250 is provided on each of the first and second arm portions 204*a*', 204*b*' of the movable stop 204' Preferably, each shock absorbing arrangement 250 includes first and second plate members 232*a*', 232*b*' positioned on opposing sides of a shock absorbing member 236'. A disc spring 222' biases the plates 232*a*', 232*b*' and the shock absorbing member 236' toward the contact surfaces 220' of the load cells 206*a*', 206*b*'. The shock absorbing arrangements 250 inhibit damage to the load cells 206*a*', 206*b*' from abrupt forces applied thereto by the movable stop arm 204'.

With reference to FIG. 20, the components of the load cells 86*a*', 86*b*' may be reversed in orientation such that the load receiving elements 216' contact internal walls 228' of the housing 208'. A contact surface 246 is defined by an end of the load cells 86*a*', 86*b*' opposite the contact end 220' of the load receiving elements 216'. Thus, with such an arrangement, the load receiving elements 216' may be protected from damage.

With reference to FIG. 21*a* through 21*c*, a modification of the steering regulator assemblies of FIGS. 1–20 is illustrated and is generally indicated to by the reference numeral 251. The steering regulator assembly 251 includes a linkage 252 having a first link member 254 and a second link member 256 joined by a coupler 258. The coupler 258 permits the two linked members 254, 256 to rotate relative to one another. The linkage assembly 252 extends between a fixed member 260, such as a bracket fixed to the hull of an associated watercraft (not shown) for example, and the steering shaft 262.

A biasing member, such as a spring 264, extends between the first link member 254 and the second link member 256 to bias the link members 254, 256 toward one another in a consistent rotational direction. For example, as illustrated in FIG. 21*a*, the steering shaft 262 is rotated in a clockwise direction toward a starboard side of the associated watercraft. The linkage assembly 252 limits rotation of the steering shaft 262 at a point when the first link member 254 and the second link member 256 are aligned, which defines a maximum turning position of the steering shaft 262. In such a position, the biasing member 264 is in a stretched orientation.

When the steering shaft 262 is rotated in a counter clockwise direction, the biasing member 264 biases the first and second link members 254, 256 toward one another on a side of the coupler 258 on which the biasing member 264 is disposed, as illustrated in FIG. 21*b*. Similarly, when the steering shaft 262 is rotated in a counter clockwise direction from the position shown in FIG. 21*b*, the linkage assembly 252 again limits the rotation of the steering shaft 262 at a position when the link members 254, 256 are aligned with one another, thus establishing a second maximum turning position of the steering shaft 262.

Preferably, the steering regulator assembly 251 includes a load cell 266 configured to determine the tensile load applied to the linkage assembly 252 when an operator of the associated watercraft attempts to rotate an operator steering control, and thus the steering shaft 262, beyond the maximum turning position shown in FIGS. 21*a* and 21*c*. One of the linkage members, and preferably the first link member 254, is constructed of, or includes, a load receiving element 266*a* constructed of a material having a property that changes in response to a change in tension on the load receiving element 266*a*. The steering regulator assembly 251 also includes a sensor 266*b* configured to sense a change in the property of the load receiving element 266*a* in a manner similar to that described in the load detection assemblies described above. Thus, a steering assist system may utilize an output signal of the sensor 266*b* to provide a steering assist force to the associated watercraft.

Figure 21:
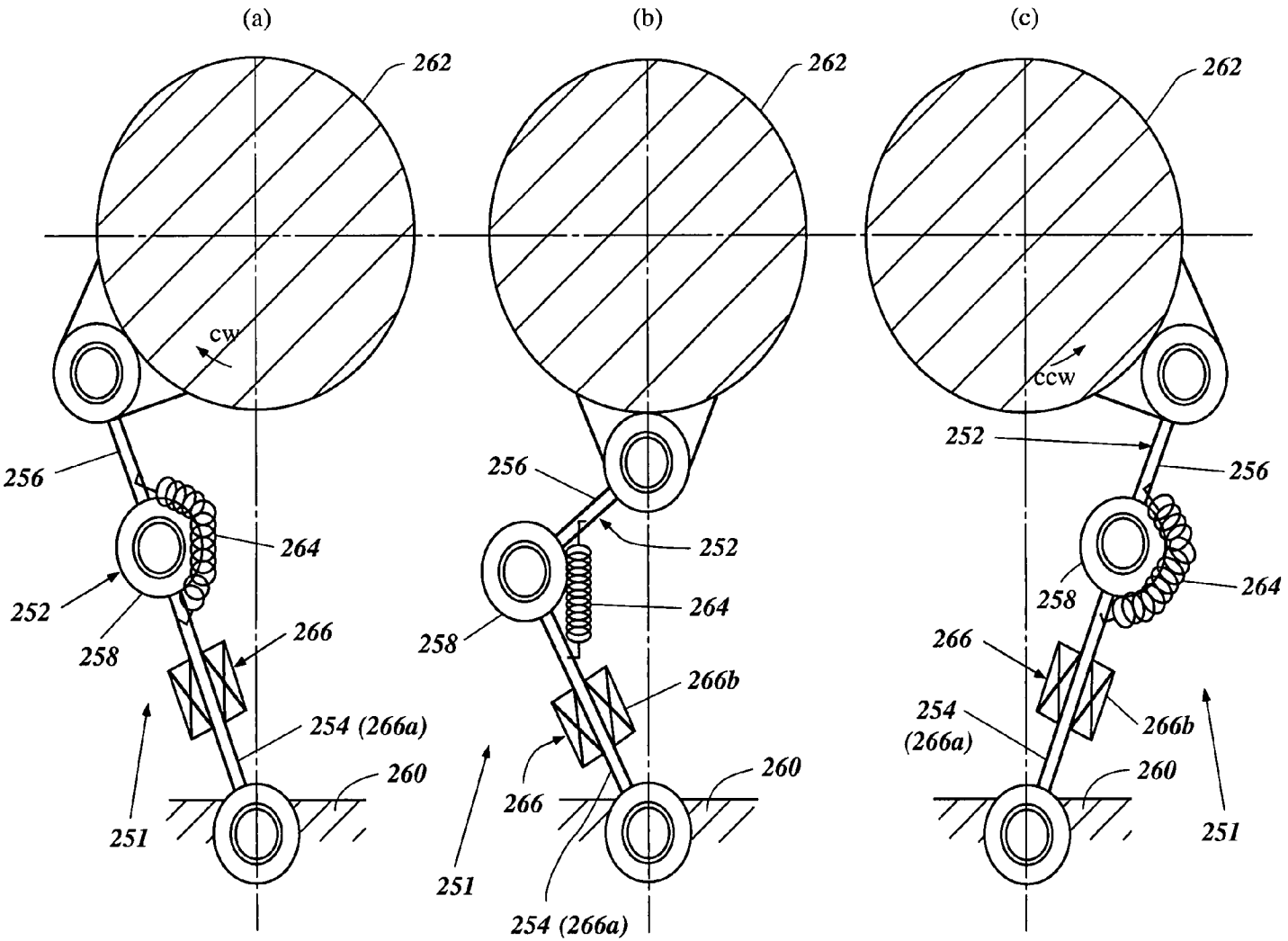
FIGS. 21*a*–*c* are top plan views of a modification of the steering assist system of FIGS. 1–20, including a linkage assembly defining the maximum turning positions of the operator steering control.
Figure 22:
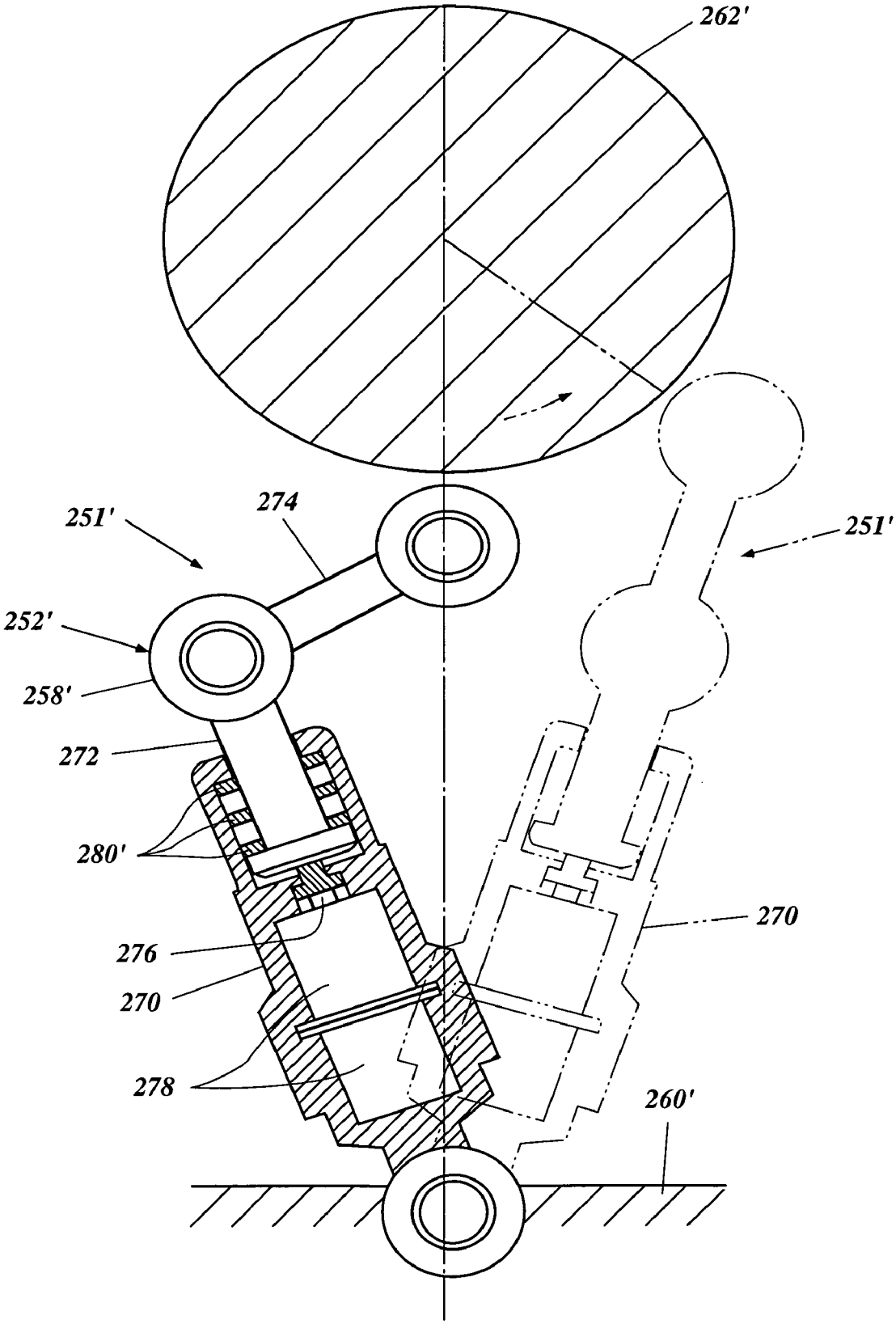
FIG. 22 is a modification of the steering assist system of FIG. 21.

FIG. 22 illustrates a modification of the steering regulator assembly 251 of FIG. 21 and is generally indicated to by the reference numeral 251'. The steering regulator assembly 251' includes a linkage assembly 252' including a first link member 270, a second link member 272, and a third link member 274. Preferably, the first and second link members 270, 272 are telescopically engaged with one another. A second and third link members 272, 274 are rotatably coupled by a coupler 258'.

The linkage assembly 252' extends between a fixed member 260' such as a bracket mounted to the hull of an associated watercraft (not shown) and the steering shaft 262'. The linkage assembly 252' defines the maximum turning positions of the steering shaft 262' in a manner similar to the steering regulator assembly 251 of FIG. 21.

As described above, the first and second link members 270, 272 are telescopically engaged with one another. In the illustrated arrangement, the first link member 270 receives the second link member 272 therein. The first link member 270 supports a load receiving element 276 therein such that the load receiving element is positioned between an end of the second link member 272 and a sensor 278. A biasing member, such as a spring 280 biases the first and second link members 270, 272 toward one another (tending to reduce a combined length of the first and second link members 270, 272). With such an arrangement, a load is applied to the load receiving element 276 by the second link member 272 due to the biasing force produced by the biasing member 280.

When the steering shaft 262' is moved from the neutral position (with the linkage assembly 252' illustrated in solid line) toward a maximum turning position of the steering shaft 262', an overall length of the linkage assembly 252' is increased until the link members 270, 272, 274 are aligned with one another (as illustrated in phantom). When an operator of the watercraft attempts to turn the steering shaft 262' beyond the maximum turning position, the third link member 274 pulls the second link member 272 in a direction away from the first link member 270 against a force offered by the biasing member 280.

Thus, when a force is applied tending to turn the steering shaft 262' beyond the maximum turning position, a compressive load on the load receiving element 276 is reduced. The sensor 278 is configured to create an output signal corresponding with a reduction in the compressive force on the load receiving element 276 to permit a steering assist system of the associated watercraft to determine a force applied to the steering shaft 262' after the steering shaft 262' has been rotated to its maximum turning position.

Figure 23:
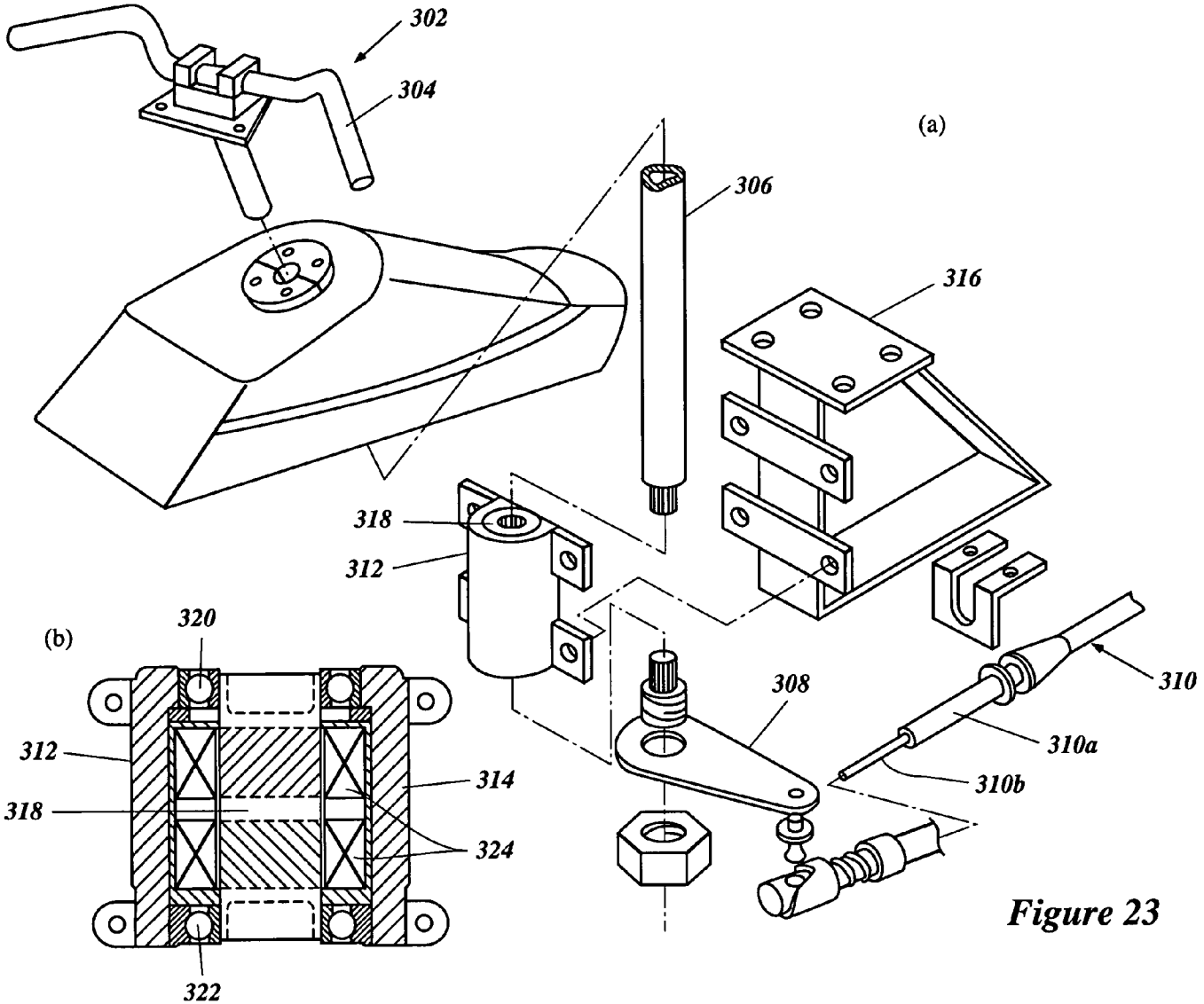
FIG. 23 is a modification of the steering assist system of FIGS. 1–22, wherein the force detection assembly is configured to detect a torsional load applied to steering shaft.

FIG. 23 illustrates yet another modification of the steering assist systems of FIGS. 1–22 and is generally referred to by the reference numeral 300. The steering assist system 300 includes an operator steering control 302, which includes a handlebar member 304. The operator steering control 302 is configured to rotate a steering shaft 306 along with rotation of the handlebar 304. The steering shaft 306, in turn, is configured to rotate a steering arm 308. The steering arm 308 applies a pushing or pulling force to an inner wire 310*b* of a Bowden wire arrangement 310, depending on the direction of rotation of the handlebar 304, to move the inner wire 310*b* relative to a housing 310*a* to alter a direction of travel of an associated watercraft, such as through pivoting a steering nozzle of a jet pump unit, for example.

The steering assist system 300 includes a force detection assembly 312 configured to determine a force applied to the handlebar 304 after the steering shaft 306 has been turned to a maximum turning position. The force detection assembly 312 includes a sensor housing 314 coupled to a fixed member within the hull of an associated watercraft, such as a hull bracket 316. A load receiving element 318 is supported within the housing by an upper bearing 320 and a lower bearing 322 for rotation relative to the housing 314. The load receiving element 318 interconnects the steering shaft 306 and the steering arm 308 and, thus, receives a torsional load transmitted between the steering shaft 306 and the steering arm 308.

The housing 314 also supports a sensor 324 configured to create an output signal corresponding to a torsional load applied to the load receiving element 318. An associated steering assist system may use the output of the sensor 324 to provide a steering assist force to an associated watercraft (not shown) in a manner similar to those described above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present steering assist system has been described in the context of particularly preferred embodiments, the skilled artisan will appreciate, in view of the present disclosure, that certain advantages, features and aspects of the system may be realized in a variety of other applications, many of which have been noted above. Additionally, it is contemplated that various aspects and features of the invention described can be practiced separately, combined together, or substituted for one another, and that a variety of combination and sub combinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A watercraft comprising a hull, a propulsion unit supported relative to the hull, a steering system configured to influence a direction of travel of the watercraft, the steering system comprising an operator steering control configured to rotate a steering shaft between a first maximum turning position and a second maximum turning position to permit an operator of the watercraft to control a position of the steering system, a force detection assembly configured to sense a force further applied to the operator steering control after the operator steering control is turned to either of the first and second maximum turning positions, and a control system configured to increase an output of the propulsion unit and to vary the increased output of the propulsion unit in proportion to variations in a magnitude of the forces further applied to the operator steering control at least during the period of increased output.

2. The watercraft of claim 1, wherein the operator steering control is a handlebar assembly and the propulsion unit is a water jet propulsion unit, the water jet propulsion unit comprising a steering nozzle adapted to be turned along with turning of the handlebar assembly.

3. The watercraft of claim 2, additionally comprising a pair of deflectors supported by the steering nozzle for pivotal motion about a generally vertical axis and straddling a flow of water issuing from the steering nozzle in a neutral position, wherein the control system is configured to rotate the pair of deflectors relative to the steering nozzle to divert a flow of water issuing from the steering nozzle in relation to the magnitude of the force.

4. The watercraft of claim 1, wherein the steering system comprises a fixed stop and a moveable stop, the movable stop fixed for movement with the steering shaft, the fixed stop and the movable stop contact one another to define the first and second maximum turning positions, and wherein the force detection assembly comprises a first load receiving element and a second load receiving element associated with one of the fixed and movable stops, and at least one sensor, the first load receiving element configured to receive a compressive load when force is further applied to the operator steering control after the operator steering control is turned to the first maximum turning position, the second load receiving element configured to receive a compressive load when force is further applied to the operator steering control after the operator steering control is turned to the second maximum turning position, the at least one sensor configured to produce an output signal corresponding to a load applied to either of the first and second load receiving elements.

5. The watercraft of claim 4, wherein the force detection assembly is a magnetostrictive detection system, the at least one sensor configured to detect a change in a magnetic permeability of either of the first and second load receiving elements.

6. The watercraft of claim 4, wherein the first and second load receiving elements are constructed from a conductive rubber material and the at least one sensor is configured to detect a change in an electrical resistance of either of the first and second load receiving elements.

7. The watercraft of claim 4, wherein the movable stop comprises a first stop surface and a second stop surface and the first and second load receiving elements are supported within an integral housing, wherein the housing defines, at least in part, the fixed stop.

8. The watercraft of claim 7, wherein axes of the first and second load receiving elements are arranged to form a V-shape when viewed along an axis of the steering shaft, the first stop surface and the second stop surface move along an imaginary circle centered about the axis of the steering shaft, and wherein the axes of the first and second load receiving elements are tangential to the imaginary circle.

9. The watercraft of claim 7, wherein the integral housing is constructed of a non-magnetic material.

10. The watercraft of claim 7, wherein the first load receiving element, the second load receiving element and the at least one sensor are sealed within the housing, with the exception of a contact surface of each of the first and second load receiving elements, by an elastically-deformable synthetic resin material.

11. The watercraft of claim 10, additionally comprising an electric circuit board electrically connected to the force detection assembly, wherein the electric circuit board is housed within the integral housing.

12. The watercraft of claim 11, wherein the electric circuit board is sealed within the integral housing by a shock absorbing material.

13. The watercraft of claim 1, wherein the steering system additionally comprises a linkage assembly configured to define the first and second maximum turning positions, the linkage assembly including a first end movable with the steering shaft and a second end fixed with respect to the hull, the force detection assembly including at least one sensor configured to produce an output signal corresponding with a tension of the linkage assembly.

14. The watercraft of claim 13, wherein the force detection assembly is of a magnetostrictive type, wherein a linkage member of the linkage assembly is constructed of a material that changes in magnetic permeability in response to a change in a tensile load applied to the material, and the at least one sensor is configured to produce an output signal corresponding to a magnetic permeability of the linkage member.

15. The watercraft of claim 1, wherein the steering system additionally comprises a linkage assembly configured to define the first and second maximum turning positions, the linkage assembly including a first end movable with the steering shaft and a second end fixed with respect to the hull, the force detection assembly including at least one load receiving element and at least one sensor, the linkage assembly configured to apply a compressive force to the at least one load receiving element, wherein a magnitude of the compressive force is reduced when force is further applied to the operator steering control after the operator steering control has been turned to either of the first and second maximum turning positions, and wherein the at least one sensor is configured to produce an output signal corresponding with a compressive force applied to the at least one load receiving element.

16. The watercraft of claim 1, wherein the force detection assembly comprises a load receiving element and at least one sensor, the load receiving element configured to be rotated with the steering shaft about an axis of the steering shaft and to receive a torsional load when force is further applied to the operator steering control after the operator steering control is turned to either of the first and second maximum turning positions, the at least one sensor configured to produce an output signal corresponding with a torsional load applied to the at least one load receiving element.

17. A watercraft comprising a hull, a water jet propulsion unit supported relative to the hull and including a steering nozzle, a steering system configured to influence a direction of travel of the watercraft, the steering system comprising an operator steering control movable between a first maximum turning position and a second maximum turning position and configured to permit an operator of the watercraft to control a position of the steering nozzle, a force detection assembly configured to sense a force further applied to the operator steering control after the operator steering control is turned to either of the first and second maximum turning positions, a pair of deflectors supported by the steering nozzle for pivotal motion about a generally vertical axis and straddling a flow of water issuing from the steering nozzle in a neutral position, and a control system configured to rotate the pair of deflectors relative to the steering nozzle to divert a flow of water issuing from the steering nozzle when the force further applied to the operator steering control exceeds a predetermined threshold.

18. The watercraft of claim 17, wherein the control system is configured to rotate the pair of deflectors through an angle proportional to a magnitude of the force further applied to the operator steering control.

19. A watercraft comprising a hull, a propulsion unit supported relative to the hull, a steering system configured to influence a direction of travel of the watercraft, the steering system comprising an operator steering control movable between a first maximum turning position and a second maximum turning position and configured to permit an operator of the watercraft to control a position of the steering system, a force detection assembly configured to sense a force further applied to the operator steering control after the operator steering control is turned to either of the first and second maximum turning positions, at least one rudder supported by the propulsion unit for pivotal motion about a generally horizontal axis from a first position not providing a substantial steering force to a second position configured to provide a steering force with a body of water on which the watercraft is operated, and a control system configured to rotate the at least one rudder toward the second position when the force further applied to the operator steering control exceeds a predetermined threshold.

20. The watercraft of claim 19, wherein the control system is configured to rotate the at least one rudder through an angle proportional to a magnitude of the force further applied to the operator steering control.

21. The watercraft of claim 19, wherein the operator steenng control is a handlebar assembly and the propulsion unit is a water jet propulsion unit, the water jet propulsion unit comprising a steering nozzle adapted to be turned along with turning of the handlebar assembly.

22. The watereraft of claim 21, wherein the at least one rudder comprises a pair of rudders straddling a flow of water issuing from the steering nozzle.

23. A steering assist method for a watercraft having an operator steering control configured to be turnable between but not substantially beyond maximum port and starboard turning positions and a propulsion unit, the method comprising determining when the operator steering control has been turned to either one of a port or starboard maximum turning position and when a magnitude of a further steering force that has been applied to the operator steering control is greater than a predetermined magnitude, detecting variations in the magnitude of a force above the predetermined magnitude further applied to the operator steering control after the operator steering control is turned to one of the maximum turning positions, and varying a steering force of the watercraft in proportion with the variations in the magnitude of force further applied to the operator steering control above the predetermined magnitude at least during varying the steering force.

24. The method of claim 23, wherein the steering force is increased in proportion to a magnitude of the force.

25. The method of claim 23, wherein the step of increasing a steering force involves increasing an output of a propulsion unit of the watercraft.

26. The method of claim 23, wherein the step of increasing a steering force involves diverting a flow of water issuing from a steering nozzle of a water jet propulsion unit of the watercraft.

27. The method of claim 23, wherein the step of increasing a steering force involves lowering at least one rudder into a position to contact a body of water in which the watercraft is operating.

28. A watercraft comprising a hull, a propulsion unit supported relative to the hull, a steering system configured to influence a direction of travel of the watercraft, the steering system comprising an operator steenng control configured to rotate a steering shaft between port and starboard maximum steering positions, the steering system being configured such that the operator steering control cannot be rotated substantially beyond the port and starboard maximum steering positions, a control system configured to increase an output of the propulsion unit after the operator steering control has been rotated to either of the port and starboard maximum steering positions and a further force has been applied, the control system including means for varying the output of the propulsion unit in proportion with changes in magnitude of the further force applied to the operator steering control.

29. A watercraft comprising a hull, a propulsion unit supported relative to the hull, a steering system configured to influence a direction of travel of the watercraft, the steering system comprising an operator steering control configured to rotate a steering shaft between a first maximum turning position and a second maximum turning position to permit an operator of the watercraft to control a position of the steering system, a force detector configured to sense a force further applied to the operator steering control after the operator steering control is turned to either of the first and second maximum turning positions, and a control system configured to increase an output of the propulsion unit in response to the force sensed by the force detector.

* * * * *

UNITED STATES PATENT AND TRADEMARK OFFICE

CERTIFICATE OF CORRECTION

PATENT NO. : 7,118,431 B2
APPLICATION NO. : 10/659424
DATED : October 10, 2006
INVENTOR(S) : Yutaka Mizuno et al.

It is certified that error appears in the above-identified patent and that said Letters Patent is hereby corrected as shown below:

At column 7, line 15, delete "chanae"and insert -- change --, therefor.

At column 20, line 56, in claim 21, delete "steenng" and insert -- steering --, therefor.

At column 20, line 60, in claim 22, delete "watereraft" and insert -- watercraft --, therefor.

At column 21, line 29, in claim 28, delete "steenng" and insert -- steering --, therefor.

Signed and Sealed this

Eleventh Day of December, 2007

JON W. DUDAS
*Director of the United States Patent and Trademark Office*